US010533756B2

(12) United States Patent
Ellingwood et al.

(10) Patent No.: US 10,533,756 B2
(45) **Date of Patent: *Jan. 14, 2020**

(54) BOILER CONTROL SYSTEM

(71) Applicant: Harsco Technologies LLC, Fairmont, MN (US)

(72) Inventors: Christopher Ellingwood, Tannersville, PA (US); Andrew Demers, Chittenango, NY (US); John Pollard, Palmer Lake, CO (US); Mark Spiridigloizzi, Easton, PA (US)

(73) Assignee: Harsco Technologies LLC, Fairmont, MN (US)

( * ) Notice: Subject to any disclaimer, the term of this patent is extended or adjusted under 35 U.S.C. 154(b) by 96 days.

This patent is subject to a terminal disclaimer.

(21) Appl. No.: 15/728,889

(22) Filed: Oct. 10, 2017

(65) Prior Publication Data

US 2018/0080663 A1 Mar. 22, 2018

Related U.S. Application Data

(63) Continuation of application No. 14/559,267, filed on Dec. 3, 2014, now Pat. No. 9,822,986.

(60) Provisional application No. 61/989,446, filed on May 6, 2014, provisional application No. 61/911,224, filed on Dec. 3, 2013.

(51) Int. Cl.

| | |
|---|---|
| ***G06F 19/00*** | (2018.01) |
| ***F24D 19/10*** | (2006.01) |
| ***F24H 9/20*** | (2006.01) |

(52) U.S. Cl.
CPC ..... *F24D 19/1009* (2013.01); *F24D 19/1066* (2013.01); *F24H 9/2057* (2013.01); *F24D 2200/04* (2013.01)

(58) Field of Classification Search
CPC ..... F24D 19/1009; F24D 9/2057; F24D 19/1066; F24D 2200/04
See application file for complete search history.

(56) References Cited

U.S. PATENT DOCUMENTS

| | | | | |
|---|---|---|---|---|
| 4,455,837 | A * | 6/1984 | Firey | F01K 23/06 122/1 C |
| 4,484,531 | A * | 11/1984 | Firey | F01K 23/06 110/342 |
| 4,498,863 | A * | 2/1985 | Hanson | F23N 1/022 431/89 |
| 4,923,117 | A * | 5/1990 | Adams | F23N 1/002 236/94 |
| 2007/0198753 | A1* | 8/2007 | Hamid | G06F 13/385 710/33 |
| 2011/0167250 | A1* | 7/2011 | Dicks | A61B 5/1112 713/2 |
| 2012/0259437 | A1* | 10/2012 | Cheng | G05B 13/027 700/45 |

(Continued)

*Primary Examiner* — Michael D Masinick
(74) *Attorney, Agent, or Firm* — Withers Bergman LLP; Alan D. Gardner

(57) ABSTRACT

A system and method for controlling a boiler comprising a microcomputer operatively connected to a microcontroller wherein the microcontroller is configured to provide flame safeguard operations and the microcomputer is configured to provide operating control instructions to the microcontroller. The boiler control system may operate either in a stand-alone, cascade master or cascade slave configuration.

20 Claims, 23 Drawing Sheets

(56) References Cited

U.S. PATENT DOCUMENTS

| | | | | |
|---|---|---|---|---|
| 2012/0318180 | A1* | 12/2012 | Bang | F23G 5/16<br>110/276 |
| 2014/0380334 | A1* | 12/2014 | Khessib | G06F 9/54<br>719/313 |
| 2015/0114320 | A1* | 4/2015 | Beveridge | F22G 5/00<br>122/479.1 |
| 2015/0345804 | A1* | 12/2015 | Ellingwood | F24H 9/2057<br>700/282 |

* cited by examiner

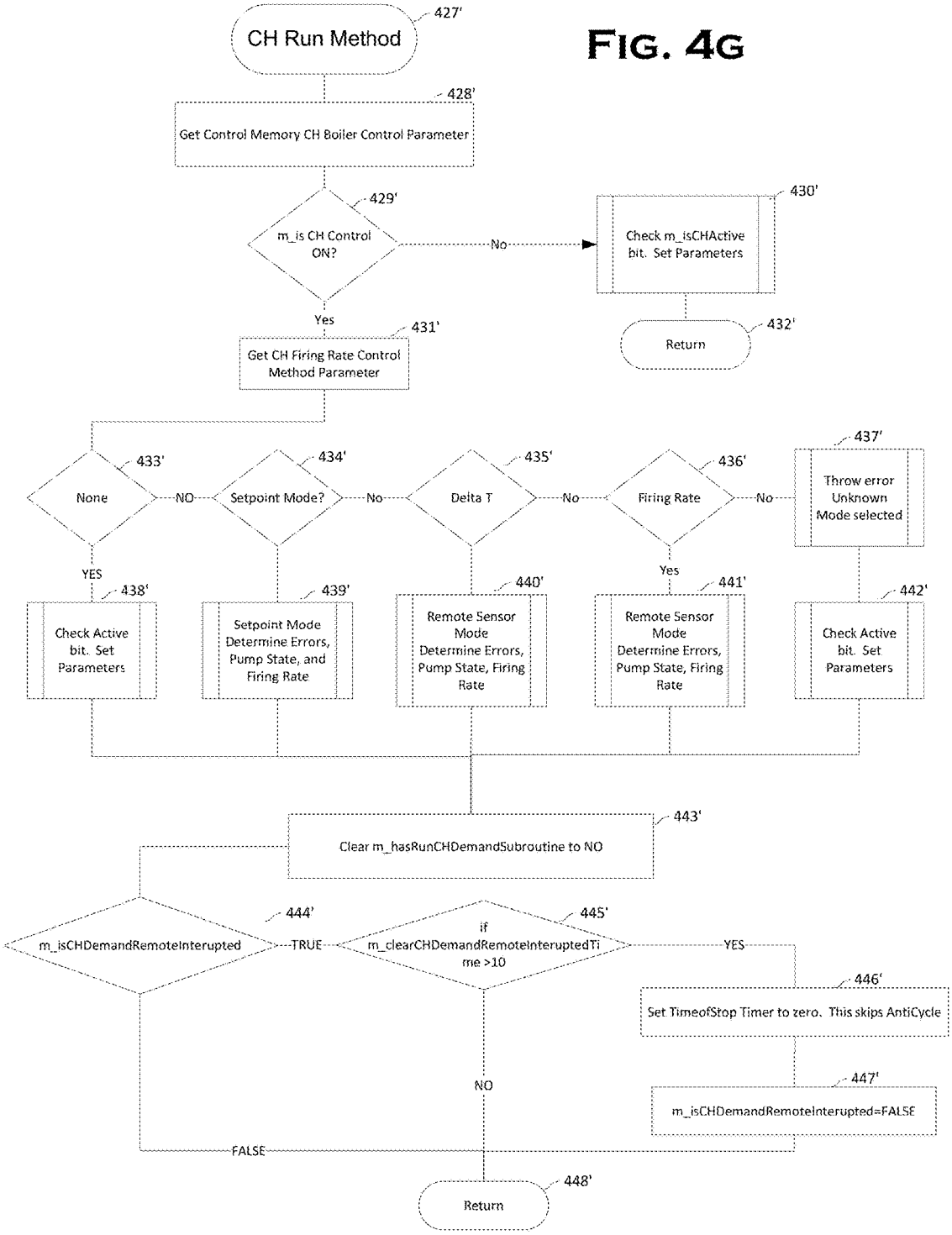
CH Run Method
427'
FIG. 4G
428'
Get Control Memory CH Boiler Control Parameter
429'
m_is CH Control ON?
No
430'
Check m_isCHActive bit. Set Parameters
Return
432'
Yes
431'
Get CH Firing Rate Control Method Parameter
433'
None
NO
434'
Setpoint Mode?
No
435'
Delta T
No
436'
Firing Rate
No
437'
Throw error Unknown Mode selected
YES
438'
Check Active bit. Set Parameters
439'
Setpoint Mode Determine Errors, Pump State, and Firing Rate
440'
Remote Sensor Mode Determine Errors, Pump State, Firing Rate
Yes
441'
Remote Sensor Mode Determine Errors, Pump State, Firing Rate
442'
Check Active bit. Set Parameters
443'
Clear m_hasRunCHDemandSubroutine to NO
444'
m_isCHDemandRemoteInterupted
TRUE
445'
if m_clearCHDemandRemoteInteruptedTime >10
YES
446'
Set TimeofStop Timer to zero. This skips AntiCycle
NO
447'
m_isCHDemandRemoteInterupted=FALSE
FALSE
448'
Return

BOILER CONTROL SYSTEM

CROSS-REFERENCE TO RELATED APPLICATIONS

This application is a continuation application of U.S. patent application Ser. No. 14/559,267, filed Dec. 3, 2014, not U.S. Pat. No. 9,882,986, and claims the benefit of U.S. Provisional application No. 61/989,446, filed May 6, 2014, and U.S. Provisional application No. 61/911,224, filed Dec. 3, 2013, the contents of which are incorporated herein by reference in their entirety

COPYRIGHT NOTICE

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

BACKGROUND

The present disclosure generally relates to a boiler control system. Prior boiler control systems rely entirely on microcontrollers. An example of a microcontroller is a dedicated device designed and programmed for a specific purpose. The microcontroller is generally dedicated to the tasks associated with its specific purpose where the relationship of inputs and outputs are specifically defined. The microcontroller may include program memory, RAM memory and input/output communication interface resources internal to the microcontroller or microcontroller chip. The internal configuration of resources reduces the size of the microcontroller and also reduces its flexibility/adaptability. The microcontroller may run a specialized operating system and provide limited support, for example, to one programming language. The less flexible nature of the microcontroller may be preferable for safety critical applications such as some boiler control system applications because the microcontroller's specialized software and operating procedures may be more tightly controlled thereby reducing the chance for errors. In many jurisdictions, a microcontroller programmed to operate safety critical functions requires a certification. Certification can be a lengthy and expensive process. In such jurisdictions, updating software, even if the update is restricted to a non-safety critical function, requires recertification. Therefore, a system having more flexibility to modify and update non safety critical functions is desirable.

SUMMARY

There is provided herein by embodiments a system and method for controlling a boiler comprising a microcontroller configured to provide flame safeguard operations by a processor (first) of the microcontroller, and a microcomputer, having a processor (second), operatively connected to the microcontroller, the microcomputer configured to provide operating control via the second processor. In further embodiments the boiler control system may further comprise a touchscreen connected to the microcomputer, or the microcomputer may comprise a first memory storing instructions for the processor to process the operating control of one or more of the following: temperature controls, pump controls; and peripheral control. The boiler control system first memory of the microcomputer may further store instructions for the operating control to determine boiler flow for processing by the second processor. The instructions for the operating control of the boiler control system to determine boiler flow may comprise the steps of: (a) determine a power P at a running speed, (b) determine a cubed ratio R by calculating the cube of a ratio between a full speed and the running speed, (c) determine a result C by multiplying the power P determined in (a) by the cubed ratio R determined in (b), (d) find an associated full speed flow Ffs from the value obtained at (c), (e) determine actual flow Fa by dividing the associated full speed flow Ffs found by (d) by a ratio of full speed to actual speed, and (f) verify flow Fa of (e). Alternatively, the boiler control system instructions for the operating control to determine boiler flow may also be calculated by the formula: $Flow=[(Fh-Fl)/(Ph-Pl)]*[(Pi*(Sm/Si)3)-Pl)+Fl]/[Sm/Si]$ wherein Pi is a power value at a given running speed in watts, Sm is a maximum running speed in hertz, Si is a given running speed in hertz, Fh is a high flow rate of a pump in gallons per minute, Fl is a low flow rate of the pump in gallons per minute, Ph is a high power value for driving the pump from a motor at the high flow rate in watts, and Pl is a low power value for driving the pump from the motor at the low flow rate in watts.

In a further embodiment the boiler control system microcomputer may further comprise one or more external interface ports to connect external devices, or the microcomputer may further comprise a first memory wherein the microcomputer provides connection, via the one or more external interface ports, to a memory device storing updated instructions for the operating control to update the first memory of the boiler control system. Updating of the operating control instructions stored in a memory of the microcomputer of the boiler control system, and return of the boiler to operating service, may occur without requiring recertification. One or more external interface ports may include one or more of the following: a Universal Serial Bus (USB) port, a secure digital memory card (SD card) slot, an Ethernet port, and a Wireless Local Area Network (WLAN).

The microcomputer may be configured to connect to one or more cascade member boilers, or to connect to the one or more cascade member boilers in a parallel configuration or in a series configuration.

The microcomputer may further comprise a first memory storing one or more operating control parameters; and an input/output communication interface for communicating, as a cascade master, at least one of the one or more operating control parameters to one or more cascade member boilers, determining what setpoint or firing rate the member boiler is to run. The microcomputer may further comprise a first memory storing heartbeat system instructions for the second processor to periodically poll cascade member boilers to determine the presence of the cascade member boiler and/or comprise a first memory on the microcomputer storing heartbeat system instructions to receive and respond to a heartbeat request from at least one of the one or more cascade member boilers by the second processor. The boiler control system microcomputer may further comprise a first memory configured to store updated instructions for the operating control received via an input/output communication interface of the microcomputer from at least one of the one or more cascade member boilers. Alternatively, the microcomputer may further comprise a first memory, and an input/output communication interface configured to receive for storage by the first memory and processed by the second processor one or more operating control parameters from a cascade member boiler, determining what setpoint or firing rate the boiler control system is to run.

None of the embodiments described herein are mutually exclusive and each embodiment may have features that may be combined in various fashion, without limitation.

BRIEF DESCRIPTION OF THE DRAWINGS

FIG. 4G is an exemplary flow diagram illustrating an alternative methodology for comfort heat control.

Figure 1:
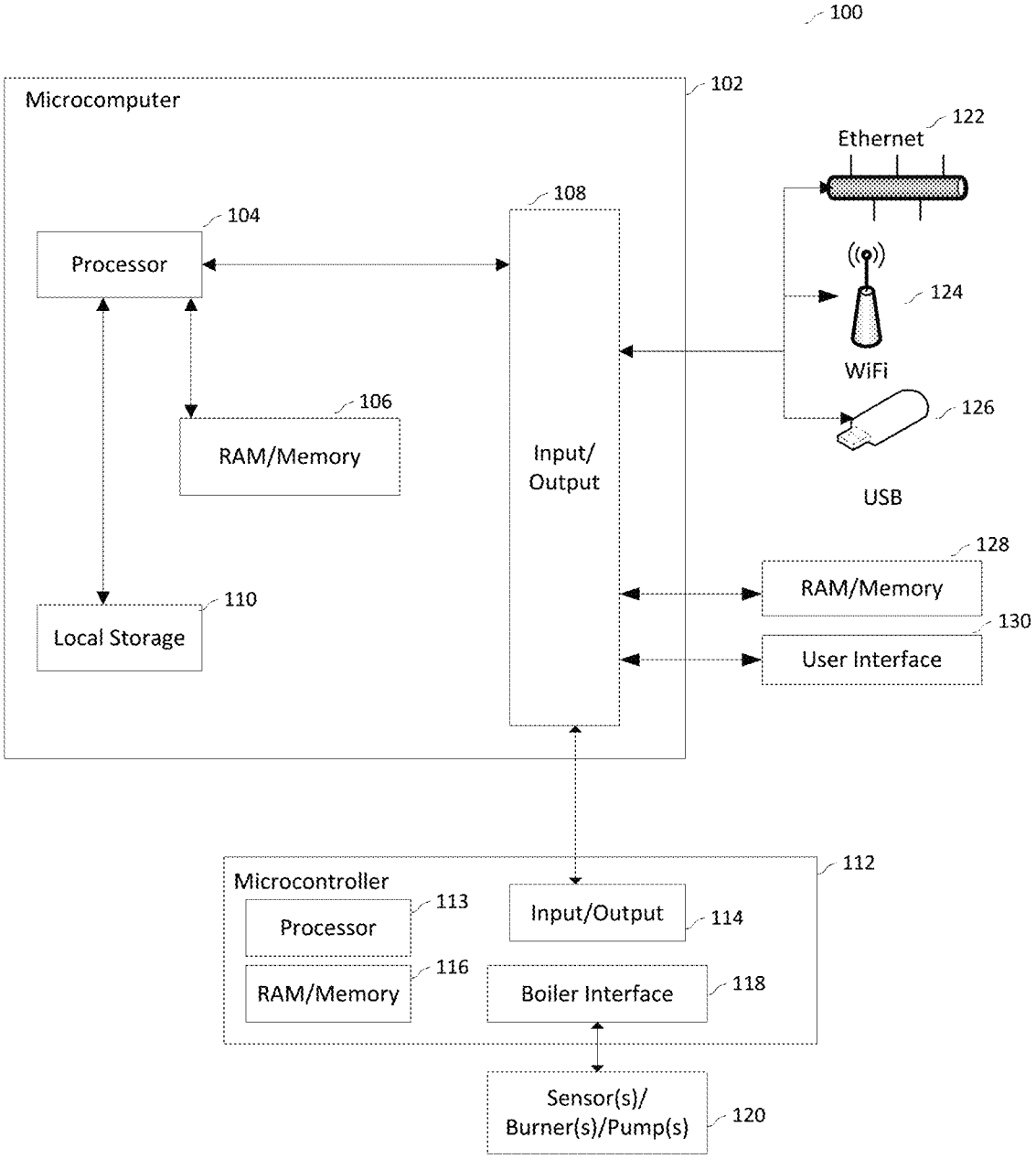
FIG. 1 is an exemplary block diagram illustrating a boiler control system using a microcomputer and microcontroller.

Identical references in the figures may be used where the items are similar, but is in no way meant to be limiting. Items referred to in later figures may have features not depicted in prior figures, such as additional communication lines or points of connection to other devices, or may have features not shown.

DETAILED DESCRIPTION

In one embodiment, the boiler control system includes a microcontroller and a microcomputer connected and in communication with each other to provide boiler combustion control. The microcontroller may be programmed with algorithms to operate safety critical functions such as boiler combustion safeguard control, which may include flame safeguard control. Safety critical functions may include any operations required by safety regulations. Flame safeguard control may include safety control that maintains a safe boiler temperature such that the temperature does not exceed a safety threshold and/or safety control that maintains a safe flame operation state (e.g., that a flame is present and there is not gas supplied without an active flame). For example, flame safeguard control may include gas valve control to turn the gas supply on and off. As another example, flame safeguard may include safe light off control to control the gas valve to provide a safe ignition. As still another example, the microcontroller may include blower control to evacuate the boiler of any gases in the boiler before the boiler lights. As still another example, the microcontroller may also be programmed to respond to external safeties such as water level switch inputs, gas pressure inputs and temperature sensors.

The microcomputer may be programmed with algorithms to operate operating controls for the boiler. Memory within the microcomputer may store the algorithms for processing by the microcomputer processor when required. Memory in the microcomputer or microcontroller may include permanent storage or temporary storage devices, such as disk drives or memory chips. Operating controls may be defined as those control operations that are not flame safeguard boiler operations. Examples of operating controls include, but are not limited to, temperature controls, pump control and peripheral control. The algorithms to operate operating controls for the boiler system may be configured into an operating program. Operating parameters generated and/or stored by the microcomputer in memory may be communicated from the microcomputer to the microcontroller to facilitate boiler operational control. Boiler values received and stored in memory at the microcontroller may be communicated to the microcomputer. The communication of operating parameters and boiler values between the microcomputer and microcontroller may be recurrent by passage of time or my some other condition, such as a change in a parameter or boiler value. Changes may also periodically occur at regular intervals. The boiler system operating program, or any parts thereof, may reside on a non-transitory computer-readable storage medium as instructions for execution by at least one processor of the boiler control system.

An exemplary microcomputer is a more general device (than a microcontroller) with more flexible processing, input, output and storage. Beyond the processor and internal memory, a microcomputer may include one or more of the various external interface ports, for example, a USB port, removable storage slot such as for secure digital memory cards (SD cards), a wide/local area network connection (wired or wireless), and support for more programming languages than the microcontroller. External components may also be used to implement program memory, processing, RAM memory and input/output communication. The operating program may reside within internal memory or on an external device connected to the microcomputer, such as a hard disk drive. The number and variety of devices that can be connected to the microcomputer is greater than those that can be connected to a microcontroller. The microcomputer may run a general operating system such as Linux and may provide support for many programming languages. The flexibility in programming and peripherals may provide for easier and more significant software updates. The functionality of the control provided by the microcomputer may be altered, in some cases significantly, enhanced or customized on-site by changing the microcomputer's programming. Software updates may be provided by, for example, USB or remotely through communication devices connected to a communication interface of the microcomputer. The communication interface, as well as the communication devices, may operate and connect using various types of wired or wireless communication methods, such as, for example, Wide area networks (WAN), Local Area Network (LAN), such as Ethernet, Wireless networks, such as cellular, Wireless Local Area Network (WLAN), such as Wi-Fi, Bluetooth or the like). Other protocols such as proprietary communication interfaces and methods may be used.

New features may be enabled by the increased availability of peripherals thereby providing an improved total boiler control experience to the user. For example, additional memory cards may record more trending data, printing capabilities may be enabled or improved, communication platforms may be added or refined, and new recording devices may be used. The use of a microcomputer may also leverage updates to support new devices developed by the electronics industry for use through standardized ports such as USB. As another example, support for communication platforms may be used to retrieve data from a boiler site (or sites). The retrieved information may be analyzed and allow for improved software and/or control algorithms to be developed. That improved software and/or control algorithms may then be transmitted to one or more boiler sites to update the boiler control system and provide improved performance and/or an improved user experience.

An additional benefit of the described system including a microcontroller and a microcomputer is that the microcomputer can be updated without requiring recertification for safety critical functions in connection with the boiler. Certifications may be a third party safety certification in accordance with required national or international safety standards for boiler Flame Safeguard Control by a recognized laboratory such as UL, CSA or ETL. This is different than standard UL or CSA electronics certification which may be required. In one embodiment, critical boiler combustion safety functions of the microcontroller, as defined by UL, CSA or ETL are not alterable by programming, or execution of programming, through the microcomputer. While the microcomputer is not certified as a combustion safety device it may be certified as an electrical device used in an appliance. Inclusion of a microcomputer allows for the advantage that the microcomputer may be updated without submitting to the boiler recertification process for combustion safety devices. Thus, in one exemplary system, the microcontroller is certified as a combustion device for boiler use while the microcomputer is certified as an electrical device used in appliances, thereby allowing for greater flexibility in providing updates to the field.

Turning to FIG. 1, the exemplary boiler system 100 uses a microcomputer 102 communicating in conjunction with a microcontroller 112 to operate the boiler (not shown). In this embodiment, the microcomputer 102 comprises a processor 104, a RAM/Memory 106, a separate local storage 110 and Input/Output communication interface 108. The RAM/Memory 106, may contain some programming code (configured as instructions), as well as contain the data used during boiler setup and operation. Local storage 110 may store programming code used by the microcomputer to setup and operate the boiler system, as described herein. The processor may be a general microprocessor or a specialized microprocessor, and is configured to operate on the stored programming code, as well as the data stored in the various memories and storage, to facilitate setup and operation of the boiler system. The microcomputer 102 communicates with external devices by use of the input/output communication interface 108. External devices include the microcontroller 112, an Ethernet 122 network, WiFi 124 network, and USB 126 enabled devices; and is done so using ports (not shown) within the input/output communication interface 108 configured for their respective task. Additional devices, such as other boilers can also be connected to the microcomputer 102 via the input/output communication interface. The Ethernet 122 network connection (or WiFi 124 network connection) can be made to facilitate wired/wireless networking with a centralized Building Management System (BMS) or to another boiler system or other boiler systems (in a master or slave(s) configuration). The microcomputer 102 can communicate via WiFi 124, or USB 126 with other devices, such as a PC. A USB memory card, otherwise known as a thumbdrive, may be used to transfer data between devices, such as in the case of passing an updated operating control program (and or it's configuration data) to an installation of a boiler control system. As described elsewhere in this disclosure, the other methods of communication may facilitate updating the microcomputer 102 operating programs. Other memory devices may also be used. Memory devices may also include devices that have memory and may be used to perform the same transfer of data as described above, or by an alternative method. The exemplary boiler system 100 may take advantage of external RAM/memory 128 if necessary. The microcomputer 100 further communicates with a user, via a user interface/display 130, such as a touchscreen display, to display status, menus and accept programming parameters for operating the boiler.

The microcontroller 112 of the exemplary boiler system 100 comprises an Input/Output communication interface 114 and processor 113 to communicate with the microcomputer. A RAM/Memory 116 is depicted to store data during operation. Just as with the microcomputer 102, the microcontroller 112 can use a separate local storage (not shown) for storing operating programs. A boiler interface 118 of the microcontroller 112 provides control of external devices 120 such as the various pumps, and valves, and igniters. Additionally, the boiler interface 118 accepts connection of sensors for receiving data such as temperatures, flow, voltages, currents and various other feedbacks as described herein.

Flow Determination

An example of an operational algorithm is a calculation of the flow of the pump, based on the amount of power used by the motor driving the pump. To carry out such a calculation the operator, or developer, might develop a dataset curve of flow vs power for full speed of the pump to aide in flow determination. Power may be a calculation based on parameter of the inverter and active current drawn by the motor driving the pump. An exemplary calculation is as follows:

Step 1: Determine the power at the running speed (Pi). The power may be determined by multiplying the measured active current (I) and voltage (V) at the inverter (e.g., an inverter that changes the frequency of the voltage supplied to the motor to act as a speed controller for the motor) supplying the boiler pump. As an example, the power (Pi) may be 75 W at a running speed of 25 Hz.

Step 2: Determine the ratio (Rr) between the full speed and running speed. Continuing with the example, if the full speed is 30 Hz, the ratio (Rr) is 1.2.

Step 3: Determine the Relative Power (Pr) by multiplying the power of step 1 by the cube of step 2. In the example, this is Pr=75 W*$1.2^3$=129.6 W Step 4: Determine the full speed flow (Ffs) associated with the value from step 3 according to Eq 1.

$$Ffs = \frac{FlowHigh - FlowLow}{PowerHigh - PowerLow} * (Step3Result - PowerLow) + FlowLow$$

For example, if a boiler pump has a flow ranging from 25 gpm to 30 gpm with a corresponding power ranging from 78 W to 93 W in the above example, the result of Eq. 1 is Ffs=42.2 gpm. Typically this step is an interpolation not an extrapolation. For example, usually the found flow will be in between the known flows.

Step 5: The flow (F) is then given by dividing the result in step 4 by the ratio of step 2. In the example, this provides a result of F=35.17 gpm.

Step 6: Verify the result of step 5 by comparing to another calculation such as a delta T calculation using the firing rate of the boiler. Verification can be done with other instrumentation such as flow meter DP cell, etc.

Combined into a single equation the formula is:

$$\text{Flow}=[(Fh-Fl)/(Ph-Pl)]*[(Pi*(Sm/Si)^3)-Pl)+Fl]/[Sm/Si]$$

wherein

Figure 2:
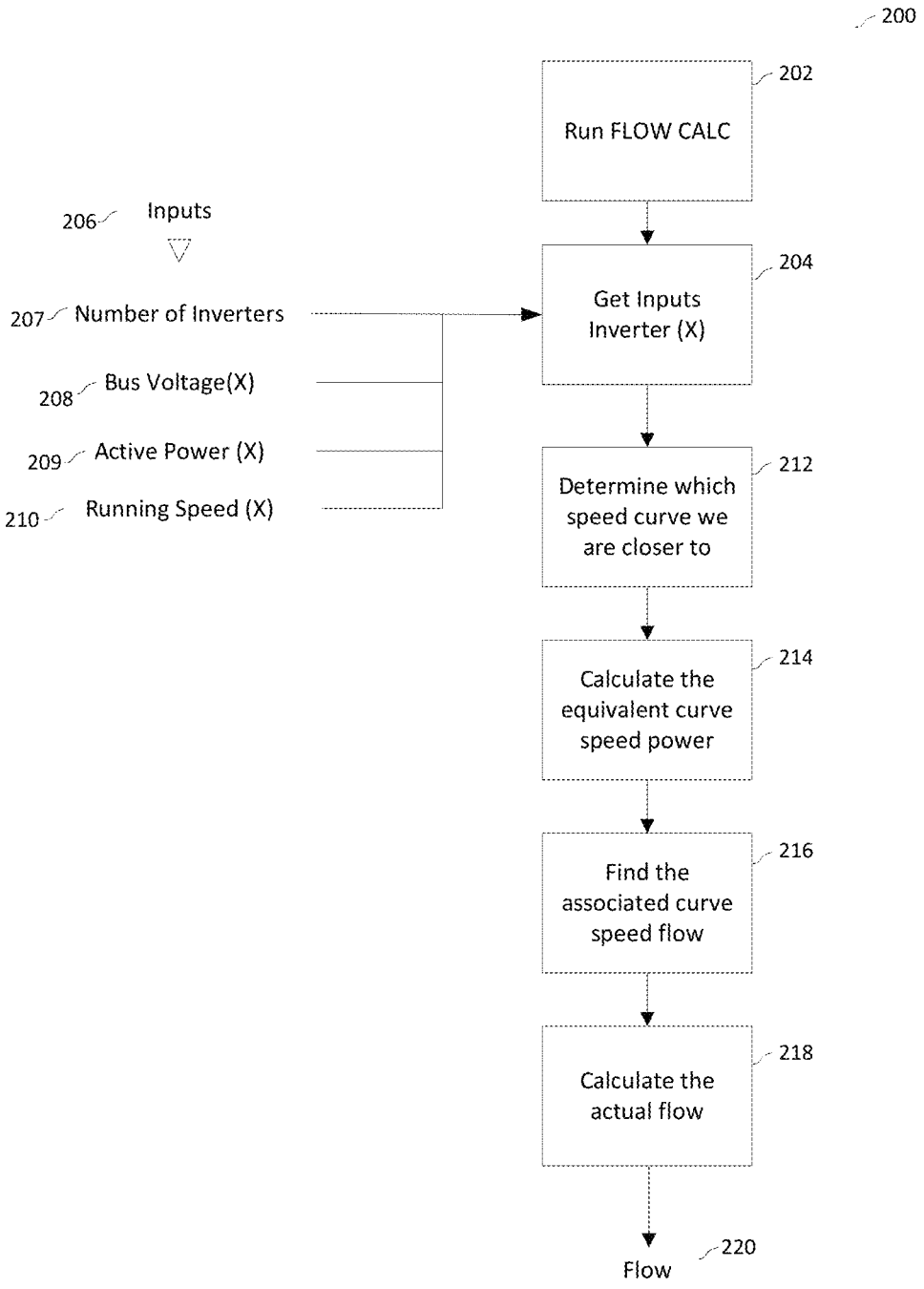
FIG. 2 is an exemplary flow diagram illustrating a flow calculation that may be used to determine boiler pump flow characteristics.

Pi is a power value at a given running speed in watts,

Sm is a maximum running speed in hertz,

Si is a given running speed in hertz,

Fh is a high flow rate of a pump in gallons per minute,

Fl is a low flow rate of the pump in gallons per minute,

Ph is a high power value for driving the pump from a motor at said high flow rate in watts, Pl is a low power value for driving said pump from the motor at said low flow rate in watts, FIG. 2 illustrates an exemplary flow determination process that may be implemented in software. The example of FIG. 2 shows an inverter flow calculation, but a differential temperature flow calculation or a flow meter flow calculation may also be used.

The steps to calculate flow are for 1 curve of flow vs power. If more flow vs power curves are known then the curve closest to the actual running speed is used. It is determined by subtraction. If more than 1 curve is known then where full speed is referenced below a reference to more than 1 speed curve may be used.

The flow determination algorithm 200 begins execution when the Run FLOW CALC command 202 is called. The process continues to get the inverter inputs 204. The inverter inputs 206 may include the number of inverters 207 included in the boiler control system, the bus voltage(s) 208, the active power(s) 209, and the running speed(s) 210.

Then, the closest speed curve is determined 212. Next, the equivalent curve speed power may be calculated 214. The associated curve speed flow may then be found 216. Then, the actual flow may be calculated 218, which may be output 220 (or returned as a variable).

Cascade Control

Another example of an operational algorithm is cascade control of multiple boilers. The cascade may be configured with multiple boilers in a series or parallel arrangement such that fluid (e.g., water) that is heated by the boilers is combined on the supply and return sides of the cascade. The cascade system may control a group of boilers based on a common header sensor. The header sensor may be a temperature sensor provided in the fluid loop for the cascade system. The cascade system may also include one or more sub-groups of boilers that may switch between CH (central heating) and DHW (domestic hot water) modes. The order of the member boilers may provide the sequence order in the cascade system. Priority groups may be assigned that may favor starting certain boilers first and stopping certain boilers first within the sequence. The member boilers in the cascade system may be sent information from the master boiler to determine what combination of setpoint or firing rate at which the member boiler is to be run. The combination may include a setpoint with no firing rate, a firing rate with no setpoint, both a setpoint and firing rate, or neither setpoint and firing rate. Information sent may indicate the member boiler is to determine the setpoint and firing rate itself. Information sent may include a specific command identifying the setpoint, firing rate, or other information from which the member boiler may determine its own setpoint or firing rate.

The master boiler may use a "heartbeat system," for example a periodic polling procedure, with the cascade member boilers to determine communication presence of the member boilers. The member boilers may also detect if communication with the master boiler is lost. In the case of lost communication with the master boiler, the cascade member has the option to enter safe mode. If the cascade member boiler should lose communication with the master boiler for some period of time and enters safe mode, then the member boiler is temporarily not in the cascade system. If this happens, the user has options that can allow the boiler to default to a standalone boiler or remain off. In standalone operation, the boiler can run and supply heat to a given setpoint.

When running a DHW cascade within the CH cascade system, it is preferable not to have the cascade master boiler also be the DHW sensor boiler. If the CH master boiler is used as the DHW sensor boiler, then the DHW remote thermostat control may not be available. While in a cascade mode, the standalone CH and DHW modes of the boiler may not be shown on a display screen that accepts inputs for control options. The cascade system may take precedence over control options for standalone boiler operation.

A. Cascade Control Options

1. Cascade Boiler Selection

A boiler may be set as a standalone, as a cascade master, or as a cascade member. A standalone boiler is not part of a cascade system and will perform the CH and DHW functions itself. A cascade member is a boiler in the cascade system that follows the master boiler for CH demands. A master boiler may do all of the processing in the cascade system. The header sensor is preferably connected to the master boiler. The master boiler may also be considered a cascade member in the cascade system. Preferably, there is only one master boiler in the cascade system.

Figure 3A:
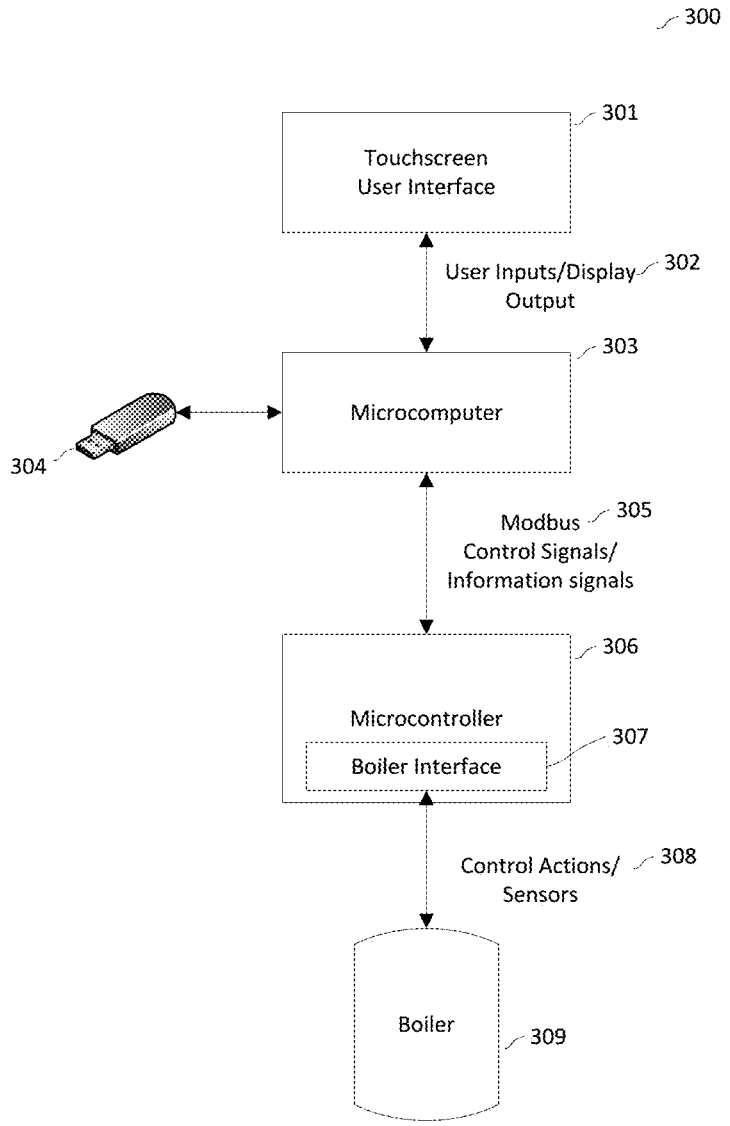
FIG. 3A-3E are exemplary block diagrams illustrating a boiler control system using various configurations, including stand-alone, paired, master-slave, master-multiple slaves, and alternate master-multiple slaves.

Turning to FIG. 3A, an exemplary stand-alone boiler system 300 configuration is illustrated by block diagram. Users of the system interface with the boiler control system via a touchscreen user interface 301 passing inputs and receiving status data over communication line 302, from microcomputer 303. As described elsewhere in the disclosure, microcomputer 303, can communicate with external devices, for example a USB thumbdrive 304, to receive updates, or download performance data to the thumbdrive 304. The download could very well be over an Ethernet connection, Wifi connection or USB cable to a PC (not shown), or through additional future communication methods. Over a Modbus connection 305, control signals and information signals are passed between the microcomputer 303 and microcontroller 306. Through the microcontroller's 306 own onboard boiler interface 307, the control signals and parameter values are passed between the microcontroller 306 and the boiler 309 mechanisms, such as the fuel valve position, and header temperature.

Communication can be analog or digital signals. Communication lines may be wireless or a single wire or cable having one or more wires. Analog signals may comprise data such as temperature by way of an analog electrical voltage or current. Digital signals may comprise data packets of various protocols and sent over lines using various standards, such as, but not limited to, serial, parallel or Ethernet (cat 3, 5, 5e).

Figure 3B:
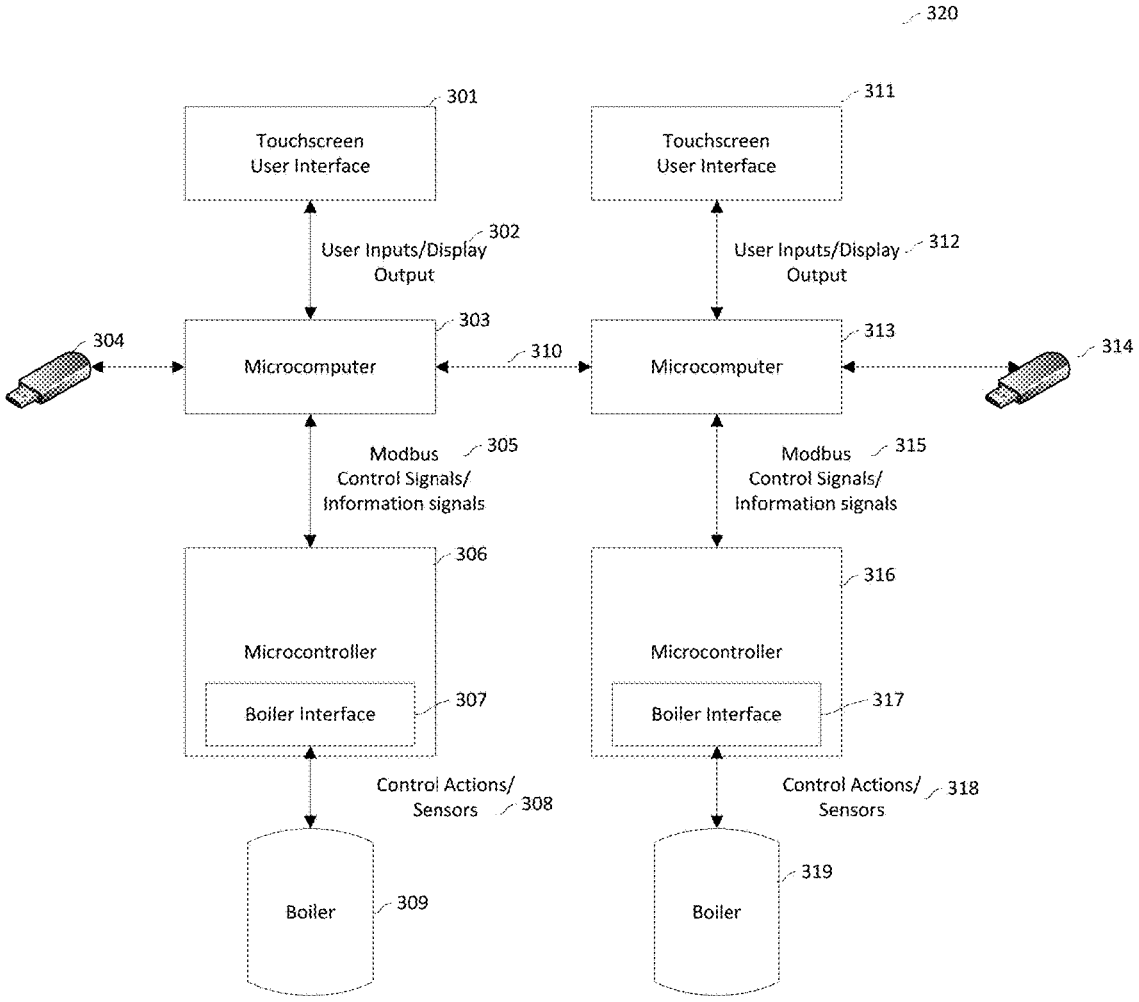

One boiler system can be paired with another boiler system, as shown in FIG. 3B, where like that of FIG. 3A the combined systems 320 each have a touchscreen user interface 301, 311 communicating with a microcomputer 303, 313 over a communication line 302, 312. Each boiler has its own capability to communicate externally via USB interface 304, 314 or by other protocols, as previously described herein. The microcomputers 303, 313 further communicate over a Modbus configured communication line 305, 315 with the microcontrollers 306, 316. Configurations other than Modbus may be used. The microcomputers 303, 313 may further share information and/or control signals over line 310, such that they may run in tandem or one provides operating data to the other for data collection or mining. The microcontrollers 306, 316 each have a boiler interface 307, 317 such that the boilers 309, 319 may operate by control actions/sensors 308, 318 on the various lines to or from each device of the boiler, like valves, and temperature sensors.

Figure 3C:
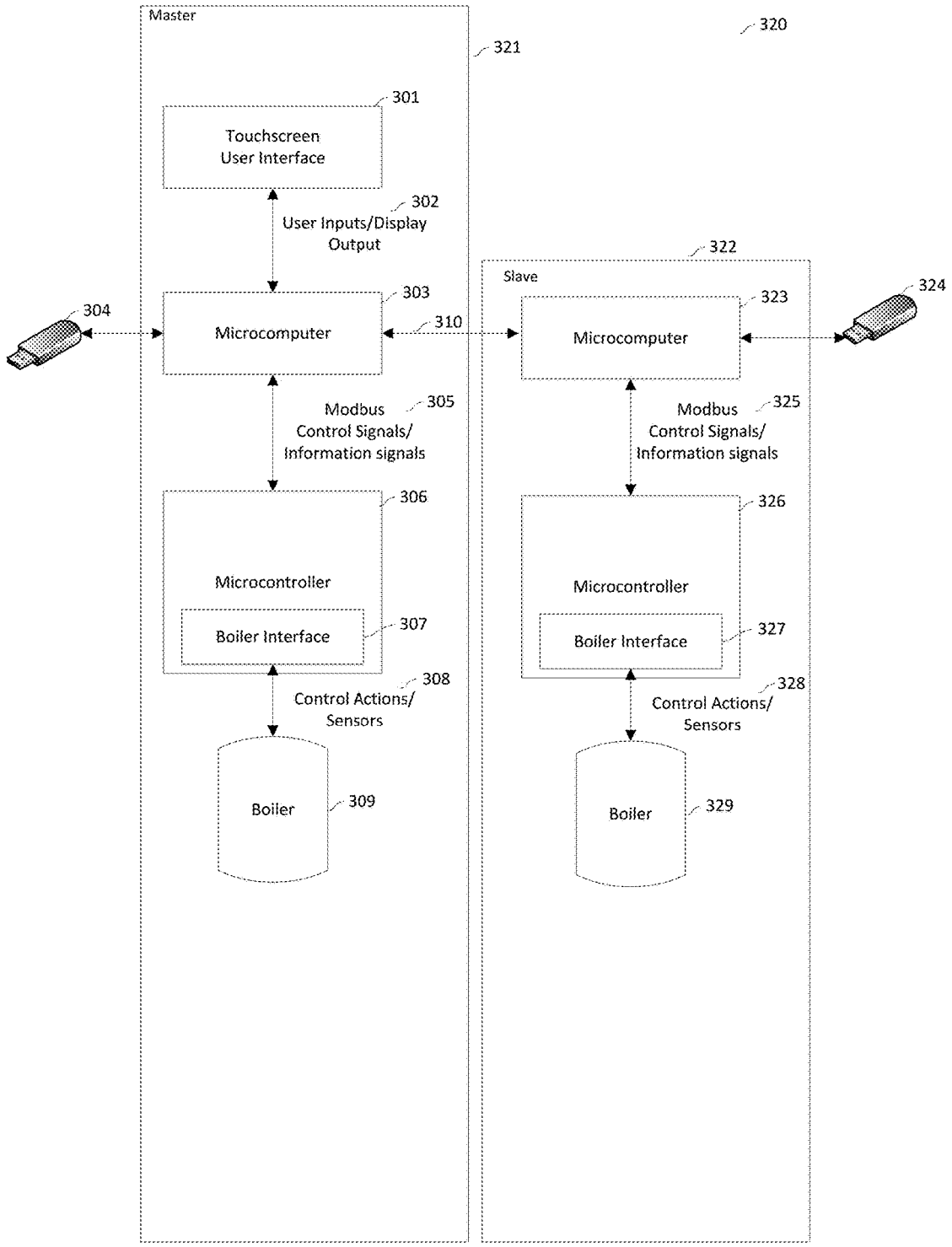
Figure 3D:
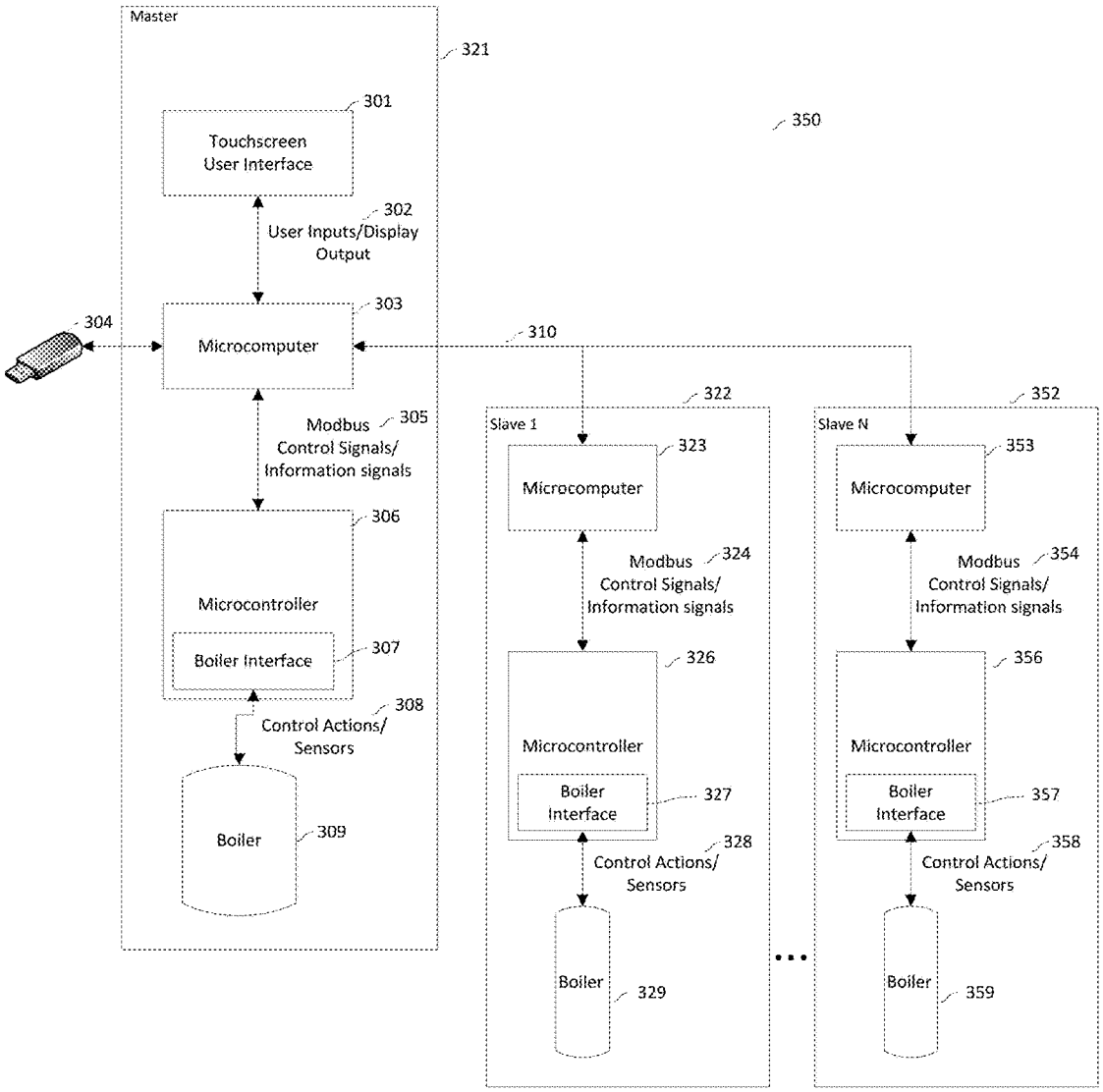
Figure 3E:
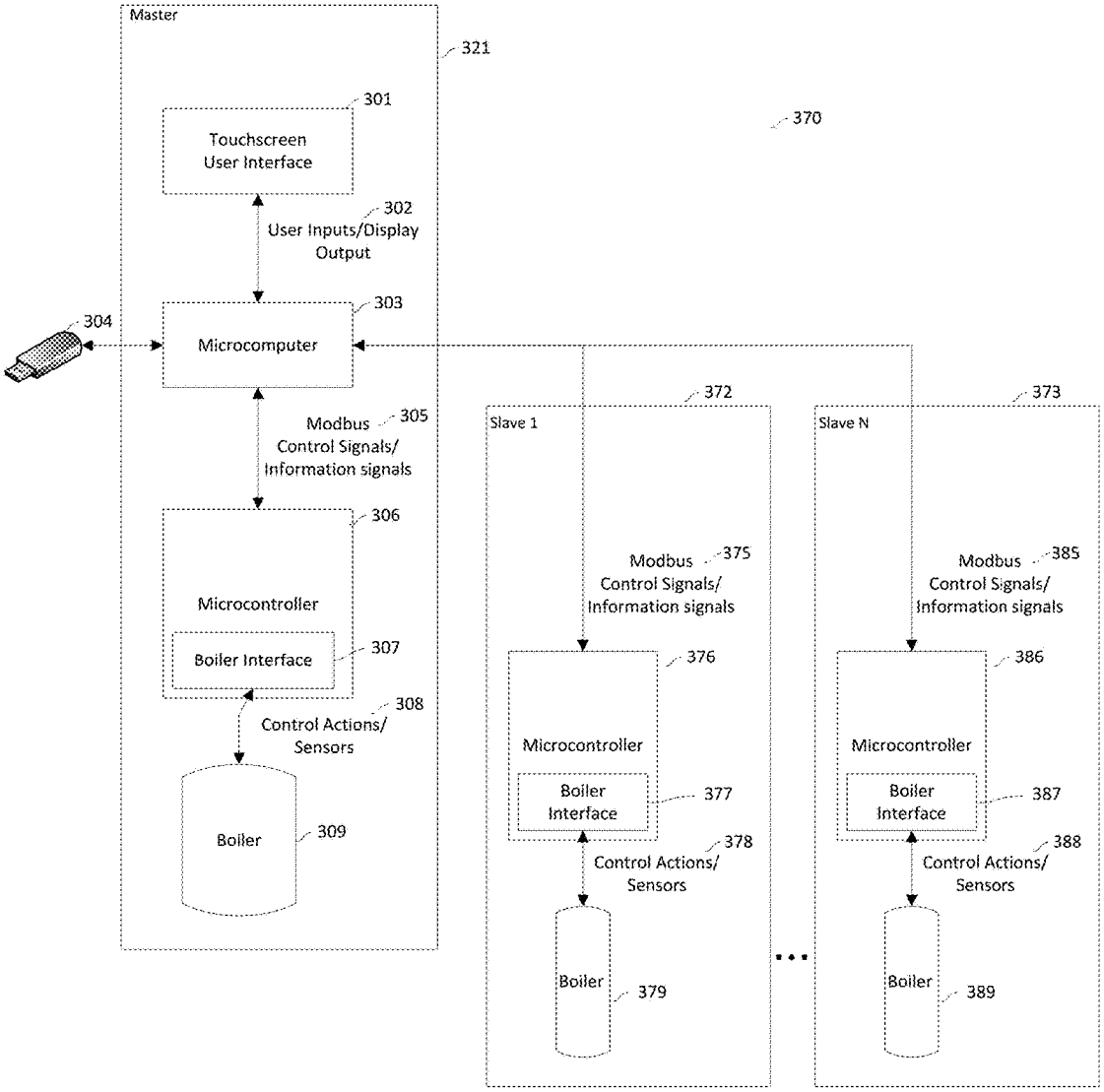

A further variant of exemplary multiple boiler operations, as previously described, are a master-slave configuration, as shown in FIG. 3C-E. Turning to FIG. 3C, the exemplary boiler control system 320 comprises a designated cascade master 321 boiler system, from which one or more cascade slave 322 boiler system(s) derives its operating program parameters via the microcomputer of the cascade master 321 (or updated operating program). In this exemplary embodiment, the cascade slave 322 is absent a touchscreen user interface. The absence of a touchscreen user interface or the lack of a depiction of the touchscreen user interface is not meant to infer that the cascade slave 322 must be with or without a touchscreen. In a configuration, such as that shown in FIG. 3, parameters for the cascade slave 322 system may be transmitted to the cascade slave 322 microcomputer 323 via communication line 310 and the respective input/output communication interface ports as shown in FIG. 1. The communication line may be by physical wire or a radio transmission as previously described. The communication protocol may be one of several forms, including Modbus. The control signals/information signals 305 are passed between the microcomputers 303, 323 and their respective microcontrollers 306, 326 to control the respective boilers 309, 329 via their boiler interfaces 307, 327 and control actions/sensors 308, 328. The sensor data from the slave system 322, travels back up the chain of devices and communication lines of the boiler interface 327, microcontroller 326, Modbus information signals 325 and microcomputer 323, before finally ending up at the microcomputer 303 of the master 321.

A master-slave configuration may contain any number of slave systems. In FIG. 3D, an exemplary illustration depicts a master-slave boiler control system 350 having a designated master 321 system and N slave systems. Slave systems 322, 352, where the slaves are, for the purpose of this disclosure, designated from 1 to N, N being any whole number greater than 1, communicate with the master 321 microcomputer 303 over communication line 310.

The communication line 310 may be a data bus type line, such as an Ethernet or other communication where signals share a common pathway. The communication line 310 may also be more than one communication line between each slave. For example, each slave may communicate directly to the master, or the slaves and master may form a daisy chain, wherein each device is addressable in the system by the master via a protocol, such as Modbus. Furthermore, the systems may communicate with each other via a switching device, such as a router or switch, or via a server. Alternatively, the master may perform the functions of a server.

Connection of slave 1 322 and slave N 352, are similar to that shown in FIG. 3C. However, in this exemplary illustration the slave systems 322, 352 may receive their updates from the microcomputer 303 of the master 321 via the input/output communication interfaces of the devices. As stated previously, although the illustrations do not show a touchscreen, the slave systems may have touchscreens. Slaves 322, 352 may alternatively receive updates, via their respective input/output communication interfaces, from external communications or devices (not shown) such as USB thumbdrives.

Although each boiler system in a cascade system having a master and one or more slaves may each comprise all of the components of a master, some components, as mentioned above may or may not be used. For example, in an alternative embodiment, the slave devices may be absent microcomputers (and therefore external device communications such as USB, WiFi and Ethernet) as well as touchscreens. In such a case, the slave systems may receive their control and parameters from a master microcomputer (the microcomputer of a master). Such is the case depicted in FIG. 3E, where the boiler control system 370 comprises a master 321, USB or other external device communications (not shown), and features similar to those depicted at least in FIG. 3B-D. However, in the case of the system depicted in FIG. 3E, the microcontrollers 376, 386 of the slave systems 372, 373 communicate with the microcomputer 303 of master 321 directly via Modbus control signals/information signals 375, 385 using their respective input/output communication interfaces, such as shown in FIG. 1. The master 321 microcomputer 303 may or may not require boosting to communicate directly to multiple slave controllers, should the sharing of signals contribute to signal strength too low to effectively operate without boost.

2. Cascade Power Modes

A cascade may be set to use individual boiler setpoints or common firing rate control. To use individual boiler setpoints, the member boilers individually control their firing rate based upon a setpoint that is calculated from the master boiler and sent to them. The individual boilers may not run at the setpoint of the system, but may vary between a high and low setpoint. This allows the boiler to react quickly to individual boiler flow changes. To use common firing rate control, the running boilers may run at the same firing rate as each other. The firing rate may be calculated from the header sensor and control parameters such as PID (proportional/integral/derivative) values. The master boiler may calculate the firing rate that is sent to the member boilers. This allows the member boilers to operate towards the same setpoint.

3. Cascade CH Modes

The cascade may be controlled in several modes. In setpoint control mode, the cascade system may be given a temperature setpoint and may control the system to heat the loop to that setpoint. In firing rate control mode, the system may be given a firing rate and may drive the boilers to match that firing rate. In delta T control mode, the running boilers may run at the same firing rate as each other calculated from the Delta T and PID values. The master boiler may calculate the firing rate that is sent to the member boilers. In flow control mode, member boilers may be started and stopped based on the total system flow rate.

4. Remote Thermostat Control

The member boiler may be optionally configured to operate based on a remote thermostat control. If enabled, the boiler may wait for remote thermostat control to be made before any actions take place in the CH mode on the boiler. If the remote thermostat control is made, a soft demand is created. The boiler may still wait for other values before a call for CH is made. If disabled, the boiler may rely on temperature sensors, such as an analog value, to determine when a call for CH is made. A call for CH refers to a demand for activation or increase in output of the cascade system (e.g., the boiler is in cascade mode).

5. System Pump Control

The system pump may be controlled in several ways. The system pump may be turned off, in which case the pump output remains off. The system pump may be turned on, in which case the pump output will remain on. The system pump may be set to operate on demand, in which case the pump output may be turned on when there is, for example, a demand for CH and off when there is not demand. The system pump may be set to operate on boiler firing in which case the pump output may be turned on when the boiler commands it to run in CH mode.

6. Anti Cycle Timer

A minimum amount of time between stopping and starting a member boiler may be set. This timer may be masked for boilers running in DHW mode or when the cascade system is in a quick start.

7. Cascade Sequence

In first on first off mode, the first member boiler that starts in the cascade will be the first boiler that turns off. The last member boiler that starts may be the last boiler that stops. The start sequence may be determined by a rotation time between the member boilers.

In first on last off mode, the first member boiler that starts may be the last member boiler that turns off and the last member boiler that starts may be the first member boiler that turns off. The start sequence may be determined by a rotation time between the member boilers.

In equal run time mode, the member boiler with the least amount of run time may start first and a running member boiler with the most amount of run time may turn off first. A start rotation sequence may not be used. This may be equal time based on the priority groups of the boilers.

8. Start Boiler Priority

The starting boiler priority may be separated into a primary starting boiler priority and a secondary starting boiler priority. The primary or secondary starting boiler priority may be selected by an outdoor air temperature (ODA) priority change parameter. When the ODA priority change parameter is set, the primary starting boiler priority may be used when the ODA temperature is above a threshold and the secondary starting boiler priority may be used when the ODA temperature is below the threshold.

The starting boiler priority may take the following modes:

In all boilers equal priority start mode, each member boiler has the same equality to start. If a non-condensing member boiler is trying to start in condensing conditions, that member boiler may be placed on hold and another member boiler will attempt to start. Once all of the member boilers are started that can run in condensing conditions and the system is still in those conditions, the non-condensing boilers can run after a hold back delay timer expires. The non-condensing boilers may then start and run in non-condensing ways.

In condensing boilers priority start mode, condensing member boilers may start before the non-condensing boilers.

In user selection list start mode, a user may be shown a list of the member boilers in the cascade system and allowed to give a starting priority to them. All boilers with the same priority number share the same priority.

9. Stop Boiler Priority

In all boilers equal priority stop mode, every boiler has the same priority to stop. In non-condensing boilers stop mode, non-condensing boilers may stop before condensing boilers. In user selection list stop mode, a user may be shown a list of the member boilers in the cascade system and allowed to give a stopping priority to them. Boilers with the same priority number may share the same priority.

10. Auto Start on Failure

If enabled and a running member boiler in the cascade system fails, then another member boiler may be started within an accelerated time. If disabled, the system is permitted to determine if another boiler is needed. If the conditions arise such that another boiler is needed, then another boiler count down will start.

11. Start Rotation Sequence

This option may be available at least in the cascade sequences first in first out and first in last out. In fixed lead mode, a lead member boiler (for example that may be designated by a selection) starts first. The lead member boiler number may be designated by a parameter. In lead rotation lead boiler run time mode, the lead member boiler may rotate based on an amount of time that lead boiler has run. In lead rotation cascade system run time mode, the lead boiler may rotate based on the amount of time the cascade system has been on. In either lead rotation mode, member boilers may be designated, for example in a list, to be included (or excluded) from the rotation. Also, in either lead rotation mode, a time period such as a number of days between lead boiler rotation may be designated by a parameter.

12. Time Before Next Boiler on

A minimum amount of time that has to pass before a next member boiler may start in the cascade system may be designated by a parameter. If conditions to start a boiler are not met, then the associated timer may optionally be reset or paused. The minimum amount of time may be overridden by a quick start timer that reduces the minimum amount of time for an accelerated start. This start timer may be masked for the first member boiler in the cascade to start to allow the cascade system to start a boiler once demand is given to the cascade system.

13. Time Before Next Boiler Off

A minimum amount of time that has to pass before a next member boiler may stop in the cascade system may be designated by a parameter. If conditions to start a boiler are not met, then the associated timer may optionally be reset or paused. The minimum amount of time may be overridden by a quick stop timer that reduces the minimum amount of time for an accelerated stop.

14. Non-Condensing Boiler Hold Back Time

A minimum amount of time after condensing boilers start before non-condensing boilers start may be designated. This threshold may be applied optionally for each additional non-condensing boiler to start.

B1. Cascade CH Power Mode Setpoint Control Options

The following control options may be provided to a member boiler configured for cascade boiler operation.

1. Boiler Max Setpoint

A maximum setpoint that the member boiler can be set to run may be designated.

2. Boiler Min Setpoint

A minimum setpoint that the member boiler can be set to run may be designated.

3. First Boiler on Setpoint

A setpoint for the first member boiler in the cascade system to start may be designated. This setpoint may be directly preloaded into the proportional term of a PID controller.

4. Boiler Setpoint Increase Proportional Band

The ratio of individual boiler setpoint increase to system error may be designated by a parameter. For example, if the parameter is set to 0.5 and the error is 10 units (e.g., degrees), the boiler's setpoint may be increased by 5.

5. Boiler Increase Firing Rate Start Timer

If the average firing rate of the running member boilers is above this designated value and lower than a designated threshold (e.g., 95%), and the power mode rate is greater than a threshold, then a timer for increasing a boiler setpoint is started. When the timer reaches a threshold value, the boilers' setpoints are increased.

6. Boiler Decrease Firing Rate Start Timer

If the power mode rate is less than a threshold and the average boiler firing rate is greater than a designated threshold (e.g., 5%), then a timer for decreasing a boiler setpoint is started. When the timer reaches a threshold value, the boiler setpoint is decreased.

B2. Cascade CH Power Mode Setpoint Control Options

The following control options may be provided to a member boiler configured for common firing rate control. The member boiler may be provided a power mode rate (e.g., 0-100%).

1. Firing Rate Control Mode

In all equal firing rate mode, all the member boilers may be sent the same firing rate. In last two modulate mode, the last two member boilers to start will modulate (e.g., firing rate will vary based on demand) and the other running member boilers may be set to a constant firing rate (e.g., 100%). In either mode, the firing rate may be dampened to change slowly to provide slow transitions and reduce impulse effects when the number of boilers changes.

C. Cascade CH Master Setpoint Control Options

1. Temperature Control Source

The temperature control source may be selected from multiple options. One option is a header sensor connected to the master boiler. Backup sensors may also be selected. The temperature control source may be used as the input measurement for the control algorithm (e.g., PID controller).

2. Setpoint Source

The setpoint source may be selected from multiple options. A fixed setpoint, for example entered on the control, may be used. A remote setpoint, for example supplied by a communication system, may be used. An external sensor, such as an outdoor air sensor, may be used. An analog input signal may be used. The setpoint may also be calculated based on the external sensor and/or analog input signal measurements.

3. Override Setpoint

The setpoint may be changed to a fixed override value on certain conditions. For example, if the average firing rate exceeds a threshold value, or if one member boiler has a firing rate above a threshold value, the override setpoint may be used. Alternatively, if the remote signal providing setpoint information is lost or unreliable, the override setpoint may be used 4. On Differential A temperature delta below the setpoint before enabling a timer for the start of a next member boiler may be designated by a parameter.

5. Off Differential

A temperature delta above the setpoint before enabling a timer for the stopping of a running member boiler may be designated by a parameter.

6. Quick Start on Differential

A temperature delta below the setpoint before enabling a timer for the start of a next member boiler for an accelerated start may be designated by a parameter.

7. Quick Stop Off Differential

A temperature delta above the setpoint before enabling a timer for the stopping of a running member boiler for an accelerated stop may be designated by a parameter.

8. Night Setback

Whether to use and the amount of an offset to apply to the setpoint during the night may be designated by parameters.

D. Cascade CH Master Firing Rate Control Options

The following control options may be provided to a master boiler configured for firing rate control.

1. Temperature Control Source

The temperature control source may be selected from multiple options. One option is a header sensor fixed to the master boiler. Backup sensors may also be selected. The temperature control source may be used as the input measurement for the control algorithm (e.g., PID controller).

2. Firing Rate Source

The firing rate source may be selected from multiple options. One option is an input, such as a sensor, coupled or fixed to the master boiler. The input may be analog or digital. Backup sensors may also be selected. The firing rate source may be used as the input measurement for the control algorithm (e.g., PID controller). Another option is a firing rate supplied by a communication connection. The firing rate may be supplied to the power modes as the power mode rate.

3. Max Header Temp

A maximum header temperature above which the cascade system may start to shutdown may be specified in a parameter.

4. Differential on

If the firing rate source exceeds a threshold value, then a timer for the start of a next member boiler may be started. The threshold may be designated by a parameter.

5. Differential Off

If the firing rate source is below a threshold value, then a timer for the stopping of a running member boiler may be started. The threshold may be designated by a parameter.

6. Quick Start Differential on

If the firing rate source exceeds a threshold value, then a timer for the accelerated start of a next member boiler may be started. The threshold may be designated by a parameter.

7. Quick Start Differential Off

If the firing rate source is below a threshold value, then a timer for the accelerated stopping of a running member boiler may be started. The threshold may be designated by a parameter.

E. Cascade CH Master Delta T Control Options

The following control options may be provided to a master boiler configured for delta T control.

1. Temperature Control Source

The temperature control source may be selected from multiple options. One option is a header sensor fixed to the master boiler. Backup sensors may also be selected. The temperature control source may be used as the input measurement for the control algorithm (e.g., PID controller).

2. Delta T Source

The delta T source may be selected from multiple options. One option is to use a fixed delta T. The fixed delta T may be entered into a control by a user. Another option is a delta T supplied by a communication connection. Another option is to calculate the delta T based on one or more analog input signals.

3. Turn Off Temperature

If the average temperature on the return temperature exceeds a threshold value, then a timer for stopping a running member boiler may be started. The threshold may be designated by a parameter.

4. Delta T Value to Turn on

At this designated delta T value, a timer for starting a next member boiler may be started. This value may be designated by a parameter.

5. Delta T Value to Turn Off

At this designated delta T value, a timer for stopping a running member boiler may be started. This value may be designated by a parameter.

F1. Cascade Member Control Options

The following control options may be provided to a member boiler. Note that the master boiler may also execute the operations of a member boiler.

1. DHW Boiler in Cascade

This option relates to whether there is a DHW boiler in the cascade system. It may designate that there is not a DHW boiler and the boiler may function as a CH boiler. It may designate that this is a member boiler that has the DHW sensors connected and performs in CH and DHW modes. Preferably, only one member boiler has this designation. It may also designate that this member boiler performs CH and DHW modes. Preferably, when there is a member boiler designated to perform CH and DHW modes, there is also a member boiler designated as having the DHW sensors.

2. Safe Mode

This option designates whether the member boiler is to turn on and run to a local setpoint if the cascade system is interrupted. The local setpoint may be designated by a parameter.

3. CH Pump Control

If the member boiler includes an output selected as a CH pump, it may be controlled in several ways. The CH pump may be turned off, in which case the CH pump output remains off. The CH pump may be turned on, in which case the CH pump output will remain on. The CH pump may be set to operate on demand, in which case the CH pump output may be turned on when there is a demand for CH and off when there is not demand. The CH pump may be set to operate on boiler firing, in which case the CH pump output may be turned on when the boiler commands it to run in CH mode.

4. CH Pump Pre Pump Time

If CH Pump Control is in an ON mode, a parameter may designate a period of time (e.g., number of seconds) the associated individual pump will run before the member boiler starts.

5. CH Pump Post Pump Time

If CH Pump Control is in an ON mode, a parameter may designate a period of time (e.g., number of seconds) the associated individual pump will run after the member boiler stops.

6. CH Time to High Fire

A minimum amount of time (e.g., in seconds) for the member boiler to reach 100% output after lighting the boiler may be designated by a parameter.

7. Acceleration Rate for Firing Rate Change

A maximum rate that the firing rate can increase over a period of time (e.g., % per minute) may be designated by a parameter.

8. Deceleration Rate for Firing Rate Change

A maximum rate that the firing rate can decrease over a period of time (e.g., % per minute) may be designated by a parameter.

F2. Cascade Member Control Options

The following control options may be provided to a member boiler that is a non-condensing boiler. Note that the master boiler may also execute the operations of a member boiler. These options may protect a non-condensing boiler under certain conditions from condensing. Non-condensing boiler types preferably do not condense since the condensate may damage the boiler.

1. Non-Condensing Hold Temperature

If the return temperature is below this designated value, then the member boiler will be placed in a hold off condition. Before the hold off condition is determined, the pump may perform a pre pump period to determine if the return temperature is accurate. Once the return temperature is above this value, then this member boiler can start and run normally. If this member boiler is forced to start in the cascade system and the return temperature is below this value, then the firing rate will be the max of the cascade system or a linear interpolation between the hold temperature and a designated non-condensing max firing rate temperature (e.g., between 1% and 100% respectively). The non-condensing max firing rate temperature may be designated by another parameter.

DHW Cascade

DHW Cascade settings may be used to run a member boiler as part of the CH cascade and a DHW system. One of the boilers in the DHW system preferably has a DHW temperature sensor connected and/or a remote sensor. In some cases, a remote sensor may only be available for DHW operation if the DHW sensor boiler is not the CH master boiler. The DHW temperature sensor may be used to calculate the firing rate of the DHW system along with control parameters such as PID values for DHW control. In some cases, one DHW boiler may run at a time. In such a case, there may be more than one DHW boiler in the DHW system and the additional boilers may act as backups. The backup boilers may be setup to rotate or be used if the primary is not available.

In some cases, when a member boiler is needed for DHW, that boiler may not supply heat to the CH system. In other words, the member boiler is not required to run in a simultaneous mode. The boiler may transfer to DHW system and back to the CH system once the demand on the DHW system is satisfied. DHW demand may be determined when the DHW temperature sensor is below the designated tank setpoint minus a designated DHW boiler differential ON parameter. The boiler may turn off when the DHW temperature sensor is above the designated tank setpoint plus a designated DHW boiler differential OFF parameter. DHW demand may also be determined by a direct command to turn the DHW system on or off. If a DHW boiler is running in CH mode and a demand is needed for the DHW system, the member boiler may transition to the DHW system without shutting down. Once the DHW demand is removed, then the member boiler may optionally transition back to the CH system or turn off.

G. Cascade DHW Master Control Options

The following control options may be provided to a boiler setup to provide DHW temperature sensors.

1. Temperature Control Source

The temperature control source may be selected from multiple options. One option is a header sensor fixed to the master boiler. Backup sensors may also be selected. The temperature control source may be used as the input measurement for the control algorithm (e.g., PID controller).

2. DHW Cascade Power Modes

A DHW cascade may be set to use individual boiler setpoints or common firing rate control. To use individual boiler setpoints, the member boilers individually control their firing rate based upon a setpoint that is calculated from the master boiler and sent to them. The individual boilers may not run at the setpoint of the system, but may vary between a high and low setpoint. This allows the boiler to react quickly to individual boiler flow changes. To use common firing rate control, the running boilers may run at the same firing rate as each other. The firing rate may be calculated from the header sensor and control parameters such as PID (proportional/integral/derivative) values. The master boiler may calculate the firing rate that is sent to the member boilers. This allows the member boilers to operate towards the same setpoint.

3. Remote Thermostat Control

The member boiler may be optionally configured to operate based on remote thermostat control. If enabled, the boiler may wait for the remote thermostat control to be made before any actions take place in the CH mode on the boiler. If the remote thermostat control is made, a soft demand is created. The boiler may still wait for other values before a call for CH is made. If disabled, the boiler may rely on temperature sensors, such as an analog value, to determine when a call for CH is made.

4. Auto Start on Failure

If enabled and a running member boiler in the cascade system fails, then another member boiler may be started within an accelerated time. If disabled, the system is permitted to determine if another boiler is needed. If the conditions arise such that another boiler is needed, then another boiler count down will start.

H1. Cascade DHW Power Mode Control Options

The following control options may be provided to a member boiler configured for DHW Cascade operation. The member boiler may be provided a power mode rate (e.g., 0-100%).

1. Boiler DHW Max Setpoint

A maximum setpoint that the member boiler can be set to run may be designated.

2. Boiler DHW Min Setpoint

A minimum setpoint that the member boiler can be set to run may be designated.

3. DHW First Boiler on Setpoint

A setpoint for the first member boiler in the cascade system to start may be designated. This setpoint may be directly preloaded into the proportional term of a PID controller.

4. DHW Setpoint Increase Proportional Rate

The ratio of individual boiler setpoint increase to system error may be set by a parameter. For example, if the parameter is set to 0.5 and the error is 10 units (e.g., degrees), the boiler's setpoint may be increased by 5.

5. DHW Boiler Increase Firing Rate Start Timer

If the average firing rate of the running member boilers is above this designated value and lower than a designated threshold (e.g., 95%), and the power mode rate is greater than a threshold, then a timer for increasing a boiler setpoint is started. When the timer reaches a threshold value, the boiler setpoints are increased.

6. Boiler Decrease Firing Rate Start Timer

If the power mode rate is less than a threshold and the average boiler firing rate is greater than a designated threshold (e.g., 5%), then a timer for decreasing a boiler setpoint is started. When the timer reaches a threshold value, the boiler setpoint is decreased.

7. DHW Shutdown on Transition

This option designates what action should be taken when DHW demand is removed. A first option is to keep the member boiler running and transition the boiler from the DHW system to the CH system if the CH cascade has demand. A second option is to stop the boiler. In such a case, the boiler may wait for CH or DHW demand to return and restart at that time.

H2. Cascade DHW Power Mode Control Options

The following control options may be provided to a member boiler configured for firing rate control. The member boiler may be provided a power mode rate (e.g., 0-100%).

1. Temperature Control Source

The temperature control source may be selected from multiple options. One option is a header sensor fixed to the master boiler. Backup sensors may also be selected. The temperature control source may be used as the input measurement for the control algorithm (e.g., PID controller).

2. DHW Setpoint

This parameter designates the current DHW setpoint. It may be read only when the DHW setpoint source is not set to a fixed setpoint.

3. DHW Differential on

This option designates an amount, for example degrees, below the DHW setpoint the temperature needs to be before enabling the DHW system.

4. DHW Differential Off

This option designates an amount, for example degrees, above the DHW setpoint the temperature needs to be before disabling the DHW system.

5. DHW Max Temperature

This option designates a threshold temperature that, when exceeded by the DHW sensor, DHW demand is removed.

I. Cascade DHW Master Control Options

The following control options may be provided to a boiler setup as a DHW cascade member.

1. DHW Pump Control

The system pump may be controlled in several ways. The DHW pump may be turned off, in which case the DHW pump output remains off. The DHW pump may be turned on, in which case the DHW pump output will remain on. The DHW pump may be set to operate on demand, in which case the DHW pump output may be turned on when there is a demand for DHW and off when there is not demand. The DHW pump may be set to operate on boiler firing, in which case the DHW pump output may be turned on when the boiler commands it to run in DHW mode.

2. DHW Pump Pre Pump Time

If DHW Pump Control is in an ON mode, a parameter may designate a period of time (e.g., number of seconds) the associated individual pump will run before the member boiler starts.

3. DHW Pump Post Pump Time

If DHW Pump Control is in an ON mode, a parameter may designate a period of time (e.g., number of seconds) the associated individual pump will run after the member boiler stops.

4. DHW Time to High Fire

A minimum amount of time (e.g., in seconds) for the member boiler to reach high fire after lighting the boiler may be designated by a parameter.

5. DHW Acceleration Rate for Firing Rate Change

A maximum rate that the firing rate can increase over a period of time (e.g., % per minute) may be designated by a parameter.

6. DHW Deceleration Rate for Firing Rate Change

A maximum rate that the firing rate can decrease over a period of time (e.g., % per minute) may be designated by a parameter.

Figure 4A:
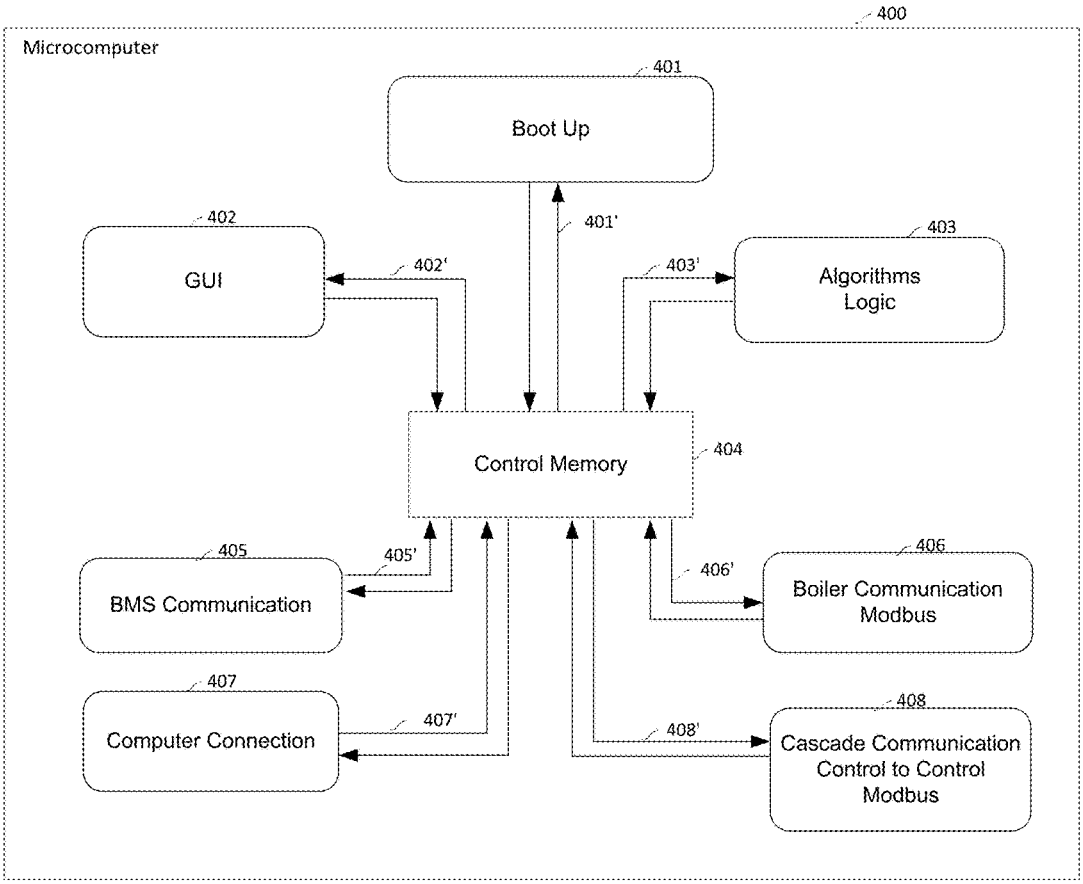
FIG. 4A is an exemplary block diagram illustrating a boiler control system logic/operational arrangement.

Turning to FIG. 4A, an exemplary microcomputer control system logic operation arrangement 400, that may be part of the boiler system operating program, is illustrated. In the exemplary embodiment depicted, a control memory 404 sends requests and receives data to and from several modules of the control program. Control Memory 404 is the centralized storage container for both the program parameters and the boiler values to instruct the boiler system. Control Memory may instantiate individual memory locations for the boiler values and program parameters as well as interface and communicate with the graphical user interface (GUI) 402 over lines 402' to receive the operator's (user's) parameters, such as operating modes and setpoints and provide information to the GUI such that the user can assess the status of the boiler system. The Boot Up 401 routines are called from the Control Memory 404 as well as the Algorithm Logic 403 routines over their respective communication lines 401', 403'. When called, the Boot Up 401 routine carries out the planned routine and returns data to the Control Memory 404, as described below. The Algorithms Logic 403 similarly receives data from Control Memory 404 relative to the boiler status and returns new/updated operating parameters data back to the Control Memory 404 for use in instructing the microcontroller to carry out the requested tasks. The instructions are communicated to the microcontroller via the Boiler Communication Modbus 406 routine over lines 406'. Building Management Systems (BMS) Communication 405 may receive, via communication lines 405' centralized data from Control Memory 404 for controlling the boiler system at a remote location using such a system. Likewise, the Control Memory 404 may receive instructions/parameters from BMS Communication 405 module instructing the Control Memory to store and effect the boiler in the manner instructed.

System performance can be monitored by a remote PC connected to the microcomputer via Computer Connection module 407 where data is communicated between the PC and the microcomputer via communications lines 407'. For cascade control of member/slave boilers, Control Memory 404 transmits and receives signals on communication lines 408' connected to Cascade Communication Control to Control Modbus 408.

Figure 4B:
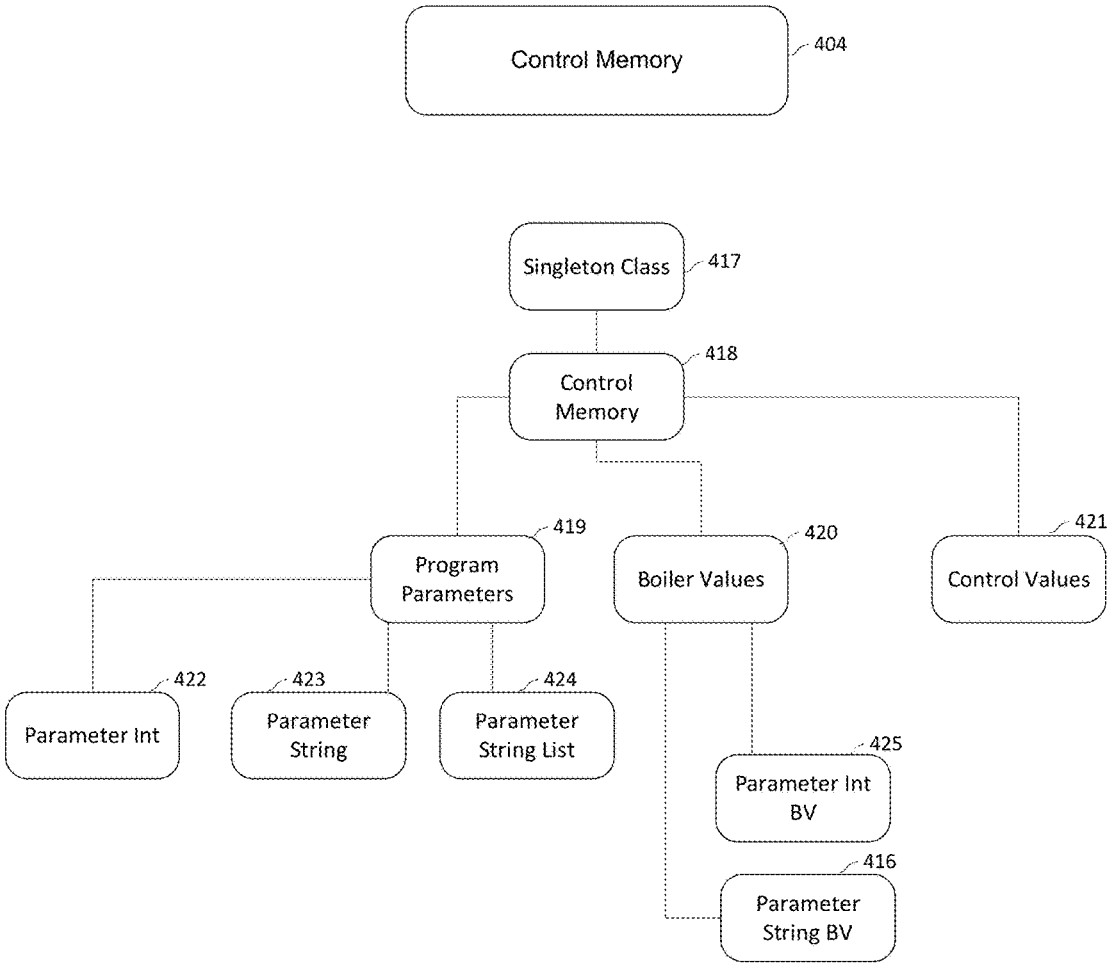
FIG. 4B is an exemplary block diagram illustrating a control memory arrangement for a boiler control system.

The Control Memory 404 routine on a microcomputer of a boiler control system may be developed from a Singleton Class 417 as shown in the exemplary illustration of FIG. 4B. A Control Memory Class 418 comprises Program Parameters 419, Boiler Values 420 and Control Values 421. The Program Parameters 419 hold the parameters that are used and set by the operating program. Some of the parameters may have a direct relationship to parameters within the microcontroller. Program Parameters 419, in the illustration comprise Parameter Integers 422, Parameter Stings 423 and Parameter String List 424.

Boiler values of the Control Memory class comprise Parameter Integer BV 425 and Parameter String BV 416, the Boiler Values 420 holding all the Modbus data that is read from the microcomputer. This data is updated from the Modbus section. Control Values 421 may be used to store states and other information that can be used to communicate between the control program sections.

Figure 4C:
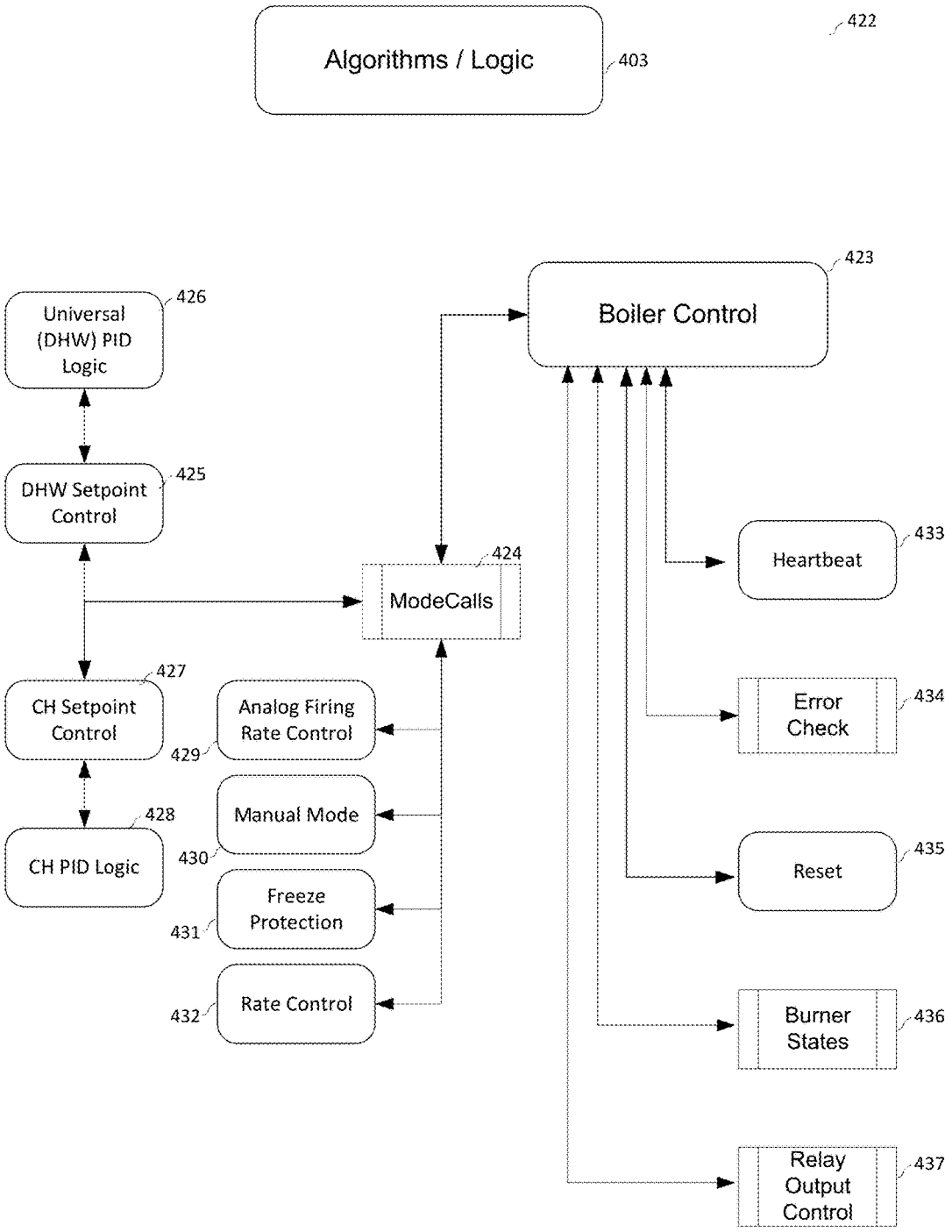
FIG. 4C is an exemplary block diagram illustrating Algorithms/Logic flow arrangement for a boiler control system.

FIG. 4C depicts an exemplary Algorithms/Logic 422 module, within the operating control programming of the microcomputer, to control the boiler. Boiler Control 423 calls ModeCalls 424 to request operational parameters to run the boiler system. ModeCalls 424 may request and receive parameter values from one, several or all of the various modes. A request to DHW Setpoint Control 425 may additional look to Universal (DHW) PID Logic 426 for the parameters concerning the PID values to carry out the DHW heating. The values from Universal (DHW) PID Logic 426 are sent back to the DHW Setpoint Control 425 where they are returned to the ModeCalls 424 in response to a request. Likewise, CH Setpoint Control 427 may look to request data from CH PID Logic 428 for parameter values concerning the comfort heat which may have been set by a user or previously stored by the control system itself. ModeCalls 424 may further receive parameter information from Analog Firing Rate Control 429, Manual Mode 430, Freeze Protection 431, and Rate Control 432.

Figure 4D:
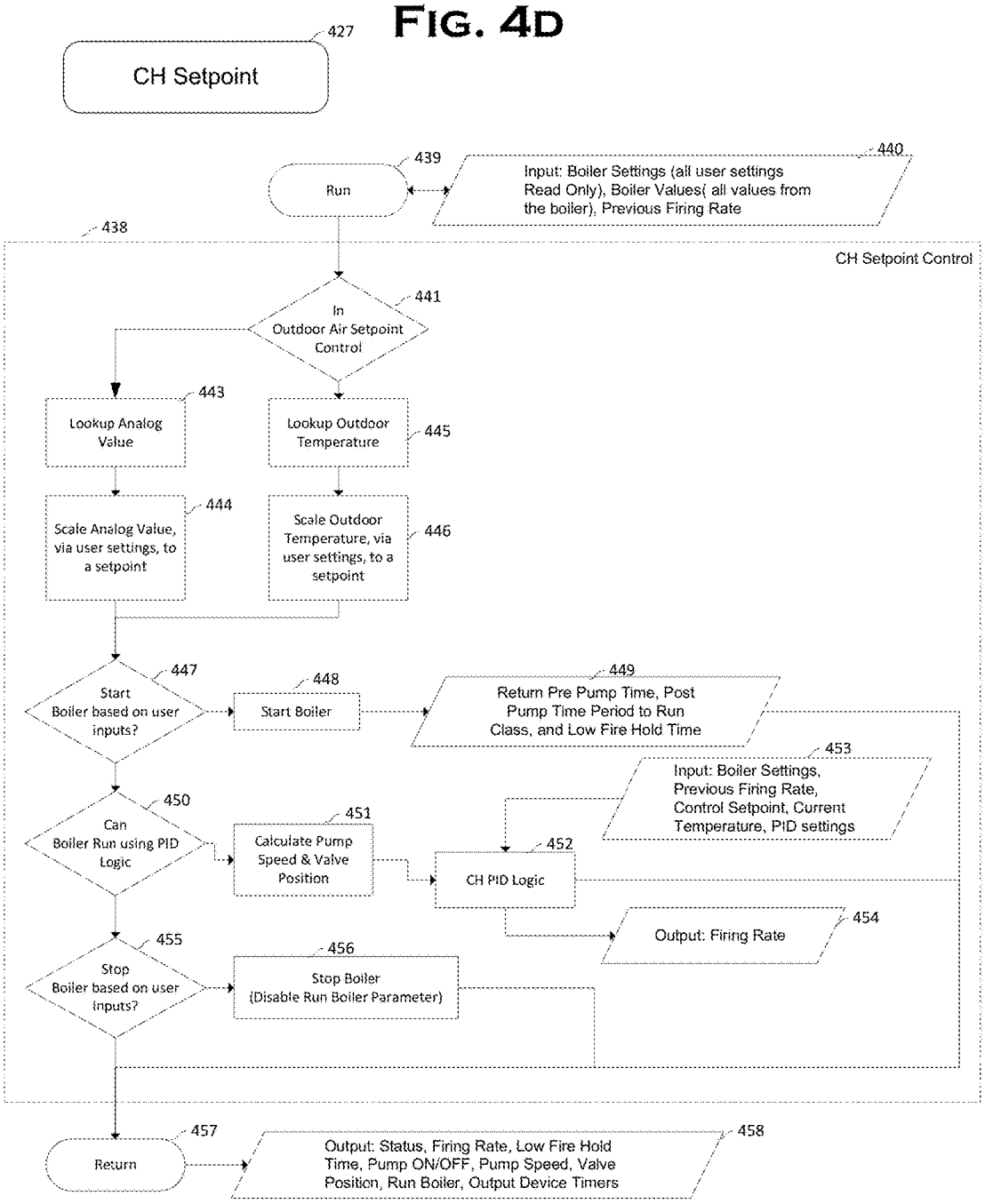
FIG. 4D is an exemplary flow diagram illustrating Comfort Heat (CH) Setpoint Control for a boiler control system.
Figure 4E:
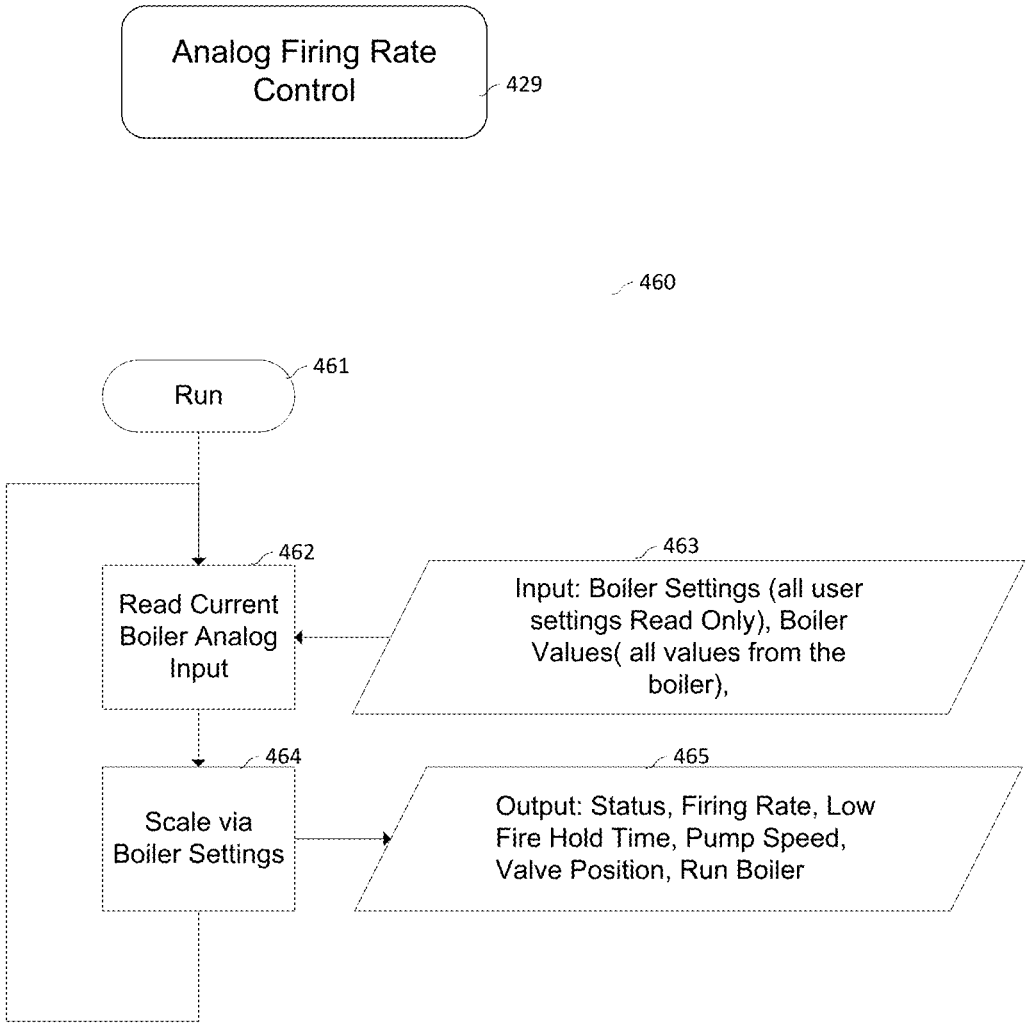
FIG. 4E is an exemplary flow diagram illustrating Analog Firing Rate Control for a boiler control system.

Analog Firing Rate Control 429, further depicted in FIG. 4E, may initiate the Run step 461. Step 462 then performs Read Current Boiler Analog Inputs, followed by step 464 Scale via Boiler Settings to the firing rate of the boiler and return the firing rate. For example, Inputs 463 may include boiler settings (all user settings—read only), and boiler values (all values from the boiler). Outputs 465, as shown in the exemplary illustration and determined by step 464, include Status, Firing Rate, Low Fire Hold Time, Pump Speed, Valve Position, and Run Boiler. These are returned to the ModeCalls 424 routine. ModeCalls 424 after receiving one or more returns from its request(s) for parameter data from these logic units, may then determine what action to take in passing parameters back to boiler control 423. It may, alternatively, be determined what mode the control is in, such as DHW, CH, Cascade, Manual, Starting, Dual CH DHW etc., then ModeCalls may choose which module to run based on the determination. ModeCalls, may call all modes before a determination is made of which parameters are passed to boiler control 423. Boiler control 423 may further take into account a return heartbeat 433 of the system, which may be derived from the master, or member boiler of a cascade system. An error checking routine 434 can be run to determine the legitimacy of any routine on the system or data entered through the various methods described herein. If a reset 435 is indicated, the boiler control 423 will take that into account when instructing the boiler operation. Burner states 436 and relay output control 437 may additionally provide operating parameters to the boiler control 423.

Turning to FIG. 4D, an exemplary illustration of CH Setpoint Control 427 on the boiler system microcomputer is depicted. This control program can handle all of the CH modes and determine what temperature sensor it should use for the PID input value. It can call the PID for the CH setpoint control, and may perform all the operations in the CH menu. Upon the Run command 439, Inputs 440 are received. Inputs 440 may be part of boiler settings, such as all user settings, which might be read only, Boiler values (from the boiler), and previous firing rate. Step 441 performs a determination of whether the system is in Outdoor Air Setpoint Control or Analog Setpoint Control. If the system is in Outdoor Air Setpoint Control the system will, at step 445, perform Lookup Outdoor Temperature then, at step 446, perform Scale Outdoor Temperature via user settings to a setpoint. Alternatively, if the system is in Analog Setpoint Control, step 443 will perform Lookup Analog Value then, at step 444, perform Scale Analog Value via user settings, to a setpoint. Either way, step 447 performs a Start Boiler based on user inputs determination. If the boiler is to be started, step 448 performs Start Boiler, returning at step 449 the Pre Pump Time, Post Pump Time Period to Run Class, and Low Fire Hold Time. If the determination in step 447 indicates to not start the boiler, a further determination in step 450 is made if the boiler can run using PID logic. If so, step 451 performs Calculate Pump Speed and Valve position, then transitions to step 452 for CH PIP Logic to receive boiler settings, previous firing rates, control setpoint, current temperature and PID settings. At step 452, CH PID logic may output at step 454 a Firing Rate for the boiler to meet the demands of the control system. Step 455 performs Stop Boiler based on user inputs determination. If the determination is favorable to stop the boiler, at step 456 the boiler is stopped, with the run boiler parameter disabled. Returned from the CH setpoint control 427 by step 457 are outputs 458, which may include the parameters of status, firing rate, low fire hold time, pump on/off state pump speed, valve position, run boiler, and output device timers.

Figure 4F:
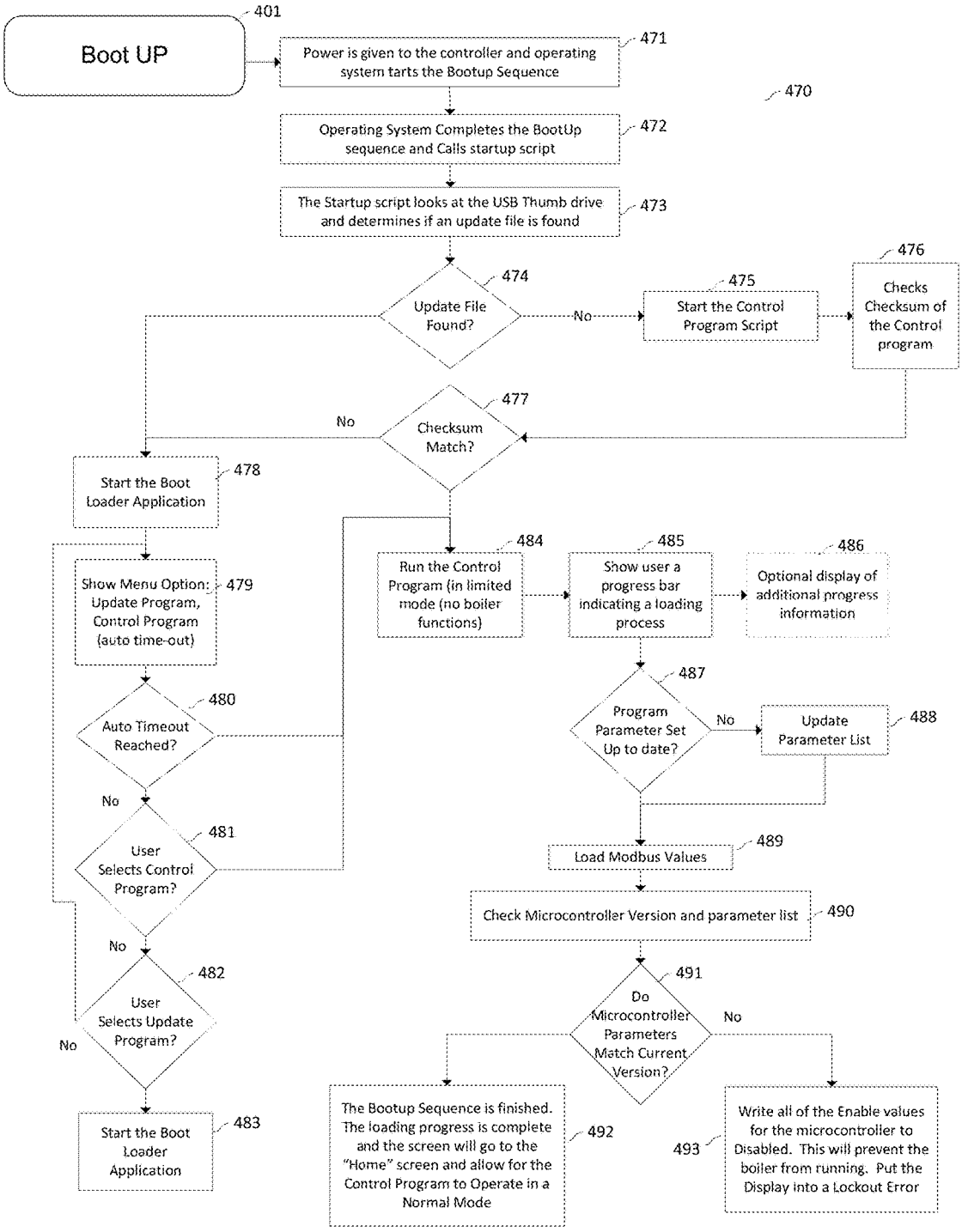
FIG. 4F is an exemplary flow diagram illustrating Boot-Up for a boiler control system.

FIG. 4F, illustrates an exemplary embodiment of a bootup sequence of the boiler control system. When power is applied to the cabinet, the computer starts and the controller starts according to the sequence below. Other variations to startup sequence can also be performed. Upon boot up step 401, power is given to the microcontroller and the microcomputer operating system starts the bootup sequence 471. The microcontroller may await instruction from the microcomputer before acting or running and may reside in a loss of heartbeat state (or disabled) until instructed by the microcomputer to transition to an active state. In step 472 the operating system completes the bootup sequence and calls startup script to initiate the program. At step 473 the startup script looks at the USB thumbdrive and determines if an update file is found. In step 474 a determination is made whether the update file was found and if not at step 475 the control program script is started. In case the program has been maliciously altered a check of the program checksum is performed at step 476 and the determination at step 477 is made whether the checksum of the program and that stored match. If so, in step 484, the control program is run in limited mode (no boiler functions) and a progress bar is shown, in step 485, to the user via the graphical user interface, to indicate a loading process. Optionally, additional information may be displayed on the user interface in step 486. If the program parameter set is up to date, as determined by step 487, step 489 loads Modbus values into memory. If the program parameter set is not up to date, such as when the program was just updated and the parameter list needs to be updated because of a parameter addition or change, step 488 will update the parameter list. As a further check on the system health and viability, step 490 checks the version of the microcontroller and parameter list. Step 491 compares the microcontroller parameters against the current version number and if found to match, step 492 transmits the home screen to the graphical user interface and allows the control program to operate in normal mode. Alternatively, step 493 will write all of the enable values for the microcontroller to disabled, preventing the boiler from running and further put the display into a lockout error condition. A lockout condition may display one or more error codes and provide instructions and limited menu function to assist with resolving the failure to start.

In the case where step 477 determines a fault with the checksum comparison, step 478 will attempt to start the boot loader application. Similarly if step 474 finds an update file on the USB thumbdrive, step 478 will start the boot loader application. Step 479, after starting the boot loader application, shows menu options: Update Program, Control Program, providing a auto timeout feature at step 480 that will attempt to perform step 484 if no selection is made prior to a predetermined time period. At step 481, a determination is made whether the user has selected the control program and if done so prior to the auto timeout feature to step 484 will run the control program (in limited mode—no boiler functions). In step 482 a determination is made as to whether the user has selected from the menu of step 479 to update the program. A favorable determination at step 482 results in starting of the boot loader application to load new software.

FIG. 4G illustrates an alternative methodology for comfort heat control. When called, "CH Run Method" 427' executes step 428' to "get control member CH boiler control parameter". A decision, at step 429', is made in determining if "m-is CH control" is on. If not, step 430' "Check m_isCHActive bit Set Parameters" is performed and the routine returns to the calling program at step 432'. Alternatively, if the "m_is CH Control" is on, step 431' performs a "get CH firing rate control method parameter" and then looks to determine at step 433' if such a parameter is present. With a CH firing rate control method parameter, steps 434', 435', and 436' determines if the system is in setpoint mode, delta T, or firing rate respectively. Without the parameter step 438' performs a "check active bit. Set parameters" routine. If the parameter indicates it is setpoint, as determined by step 434', step 439' performs "Setpoint Mode Determine Errors, Pump State, and Firing Rate" routine(s). If the parameter is delta T step 440' performs "Remote Sensor Mode Determine Errors, Pump State, Firing Rate" routine(s). If the parameter indicates a firing rate, step 441' performs "Remote Sensor Mode Determine Errors, Pump State, Firing Rate" routine(s). Otherwise step 437' performs "Throw error Unknown Mode selected", then "Check Active bit. Set Parameters" routines. Following steps 438' through 442' step 443' performs "Clear m_hasRunCHDemandSubroutine to NO" routine and step 444' determines if "m_isCHDemandRemoteInterupted" is true or false. If the determination is false, the control is returned to the calling program at step 448'. A result of true encounters a further determination at step 445' "if m_clearCHDemandRemoteInteruptedTime>10". If not the program returns at step 448'. If so, step 446' sets time of stop timer to zero (skipping AntiCycle) then sets at step 447' the parameter m_isCHDemandRemoteInterupted=FALSE, and turns at step 448'

User Interface

The user interface touchscreen display coupled to the microcomputer provides setup and runtime interface of the boiler for a user or operator. The interface allows monitoring of the boiler operation from various screens during run operation. Screens may also be tailored for specific setup configurations that must be performed during an initial installation or restart, if reprogramming the parameters is required. The touchscreen display can display values, as well as text in color and accept user designation of controls via the touch surface. Buttons and status indications may use color to reflect a particular state or status. Colors may be used in scales and charts to depict temperature or variations in settings. For example, a temperature setpoint scale may show blue at the colder end of the scale and red at the upper end of the scale. The scale may also change color as the parameter values are entered/adjusted. The touchscreen display may also use various icons or graphics to depict a certain screen or a button's function. For instance, a home button may have an icon that resembles a house. The background of the touchscreen display may also be colored or display a graphic. The graphic may relevant to a particular display, such as for a home screen or a error screen. The background graphic, as well as the icons and colors may change over the course of time, such as by an animated image, possibly to indicate activity, actions or conditions that require attention. The screen may have several modes of operation. For example, a currently active display screen may remain static (with or without animated images), automatically transition to a sleep or off state, or automatically cycle through various screens at predetermined intervals, using predetermined screens, during normal operating conditions. Variations in the screen or transition to sleep mode may protect the screen from premature failure or burn-in. The system may allow the user to designate various mode conditions, such as which of the modes to operate under. For example, a technician may want a certain screen to remain up during service, or alternate between one or more screens. During boiler setup, the currently active screen may remain displayed, or cycle to a sleep or off mode to save on screen life. The microcomputer, coupled to the touchscreen display accepts user inputs and transmits back to the display indications of the users inputs, menus and monitoring information, such as temperatures.

Figure 5:
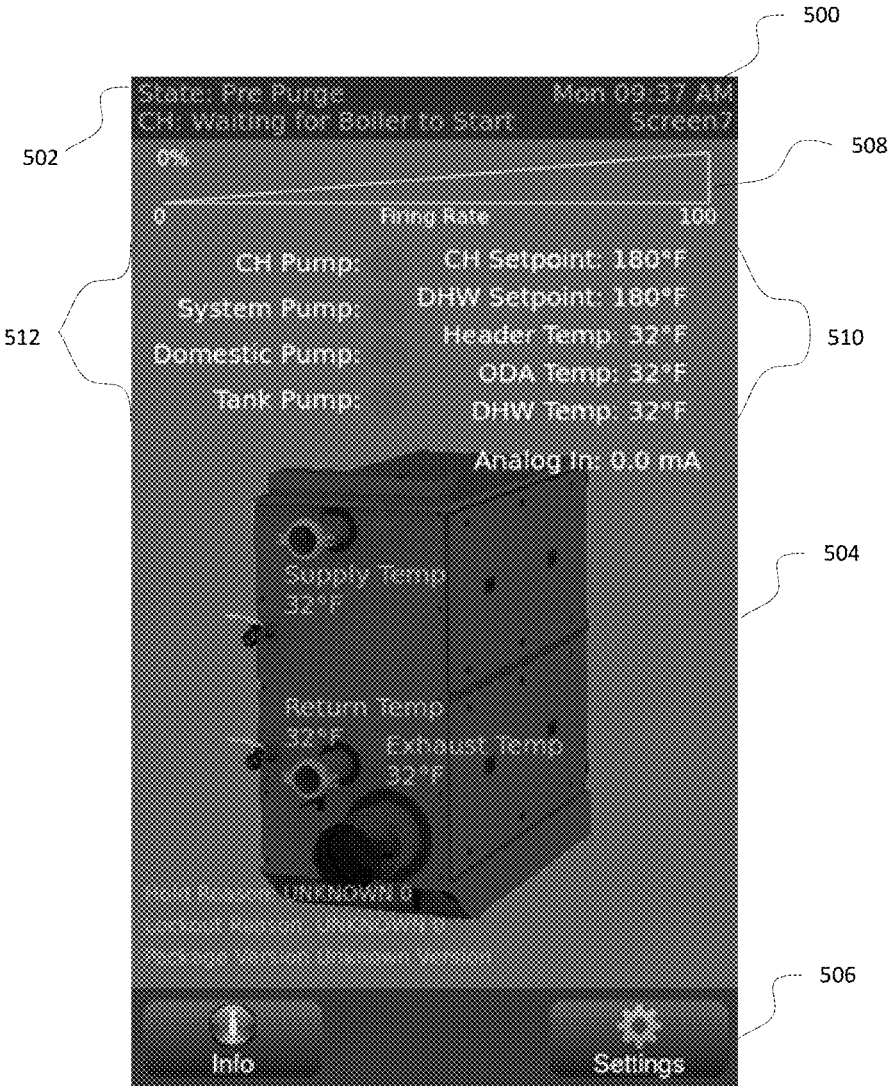
FIG. 5 is an exemplary Home touch-screen image for a boiler control system.

FIG. 5 depicts an exemplary touchscreen display showing a home screen 500 of the boiler control system. The display is divided into a status section 502 at the top and graph depicting a percent scale of the firing rate of the boiler. Area 510 displays temperature values, such as comfort heat (CH) setpoint, domestic hot water (DHW) setpoint, header temperature, ODA temperature, DHW temperature and an analog input value. Pump status can be derived from area 512 of the touchscreen display where colors may be used to show the state of the pump. Various pumps may be shown, such as comfort heat pump, system pump, domestic pump and tank pump. The lower portion of the touchscreen display programmatically various buttons for interaction with the user. In this case, an info button and a setting button are provided. Icons are also included in the graphic of the button to facilitate clarity and more rapid determination of button function. The center portion of the home touchscreen displays a supply temperature and a return temperature, but may show other values as determined by the user or program settings.

Figure 6A:
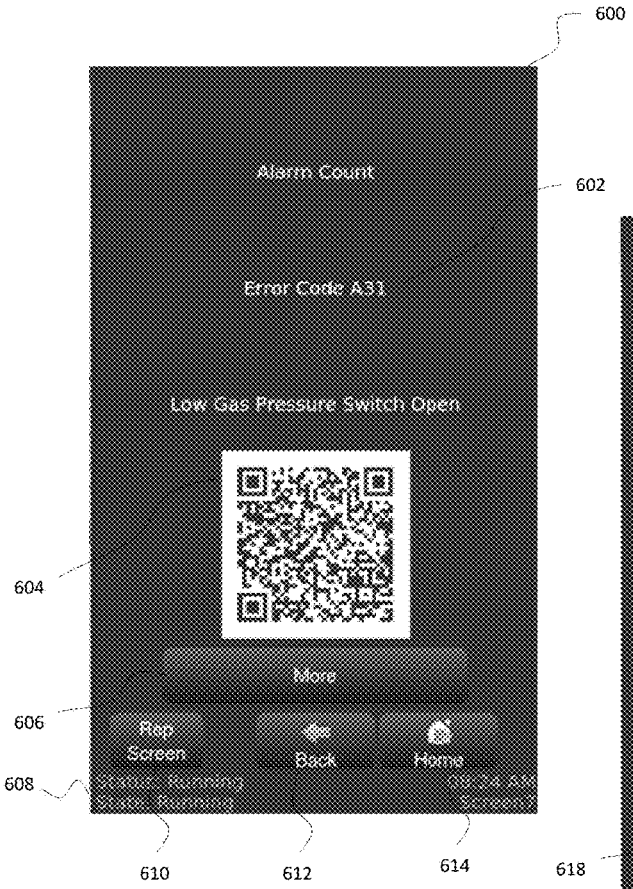
FIGS. 6A-B are exemplary Error touch-screen images for a boiler control system.
Figure 6B:
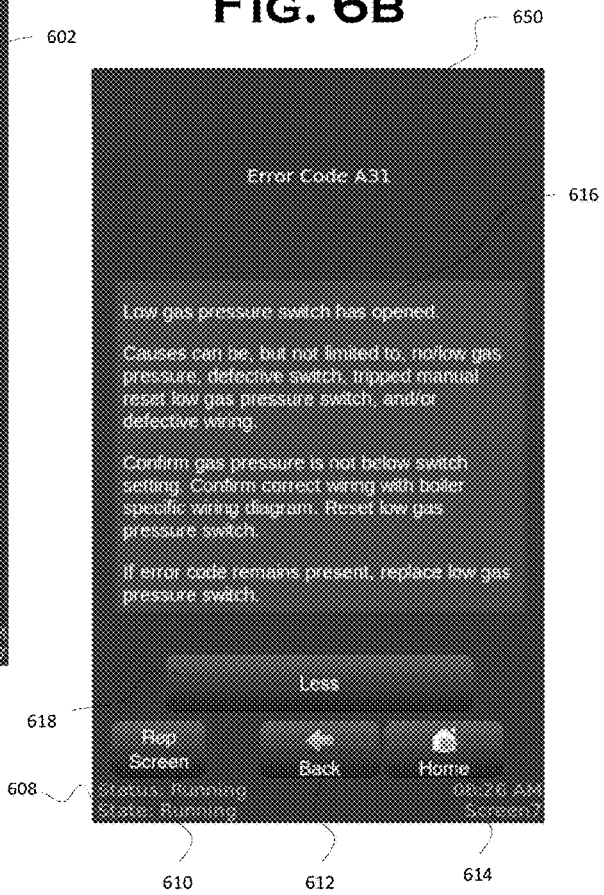

FIG. 6A-6B illustrate exemplary touchscreen display showing error screens 600 and 650. Screen 600 identifies an error code 602 along with a brief description of the error, and a scannable 2*d* code for obtaining additional information via a mobile device, such as a cellular smartphone. More button 606 if pressed by the user, provides a request to the system to show additional error information, such as that shown at 616 of FIG. 6B. Likewise, a Less button 618 is provided to return to the prior touchscreen display 600, where less information is displayed. More button 606 may be disabled if no further information is available. Similar to both touchscreen displays, are Rep Screen button 610, Back button 612, and Home button 614. In these touchscreen display illustrations, the status bar 608 is shown at the bottom of the screen.

Figure 7:
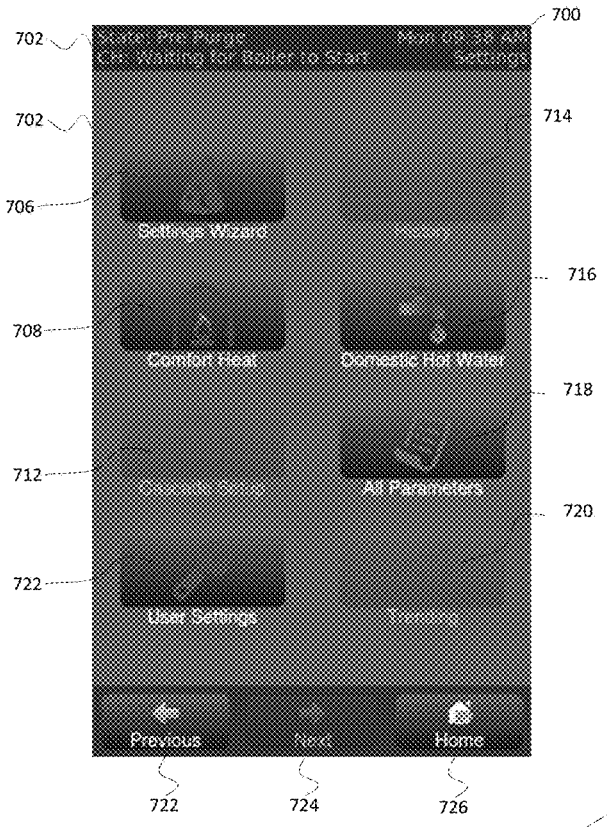
FIG. 7-8 are an exemplary Set-Up touch-screen images for a boiler control system.

FIG. 7 illustrates a menu depicted on an exemplary touchscreen display 700. The touchscreen display, like the home screen has a status bar 702 at the top portion of the screen, the center portion 704 of the touchscreen display provides touchscreen menu buttons for user interface with the boiler control system. Menu buttons include settings wizard 706, comfort heat 708, cascade setup 712, user settings 722, history 714, domestic hot water 716, all parameters 718 and trending 720. Alternative buttons may be shown and one or more screens may be used to display more or less buttons for the user. Similar to screens described above, a touchscreen display lower portion provides navigation buttons to move from screen to screen. For example, a previous button, 722, a next button 724, and a home button 726 are provided. Some of the menu selections may be grayed out if the feature is not yet enabled due to the current status of the system. For instance, the history button 714 may be grayed out because the boiler has yet to be started and no history is available for display.

Figure 8:
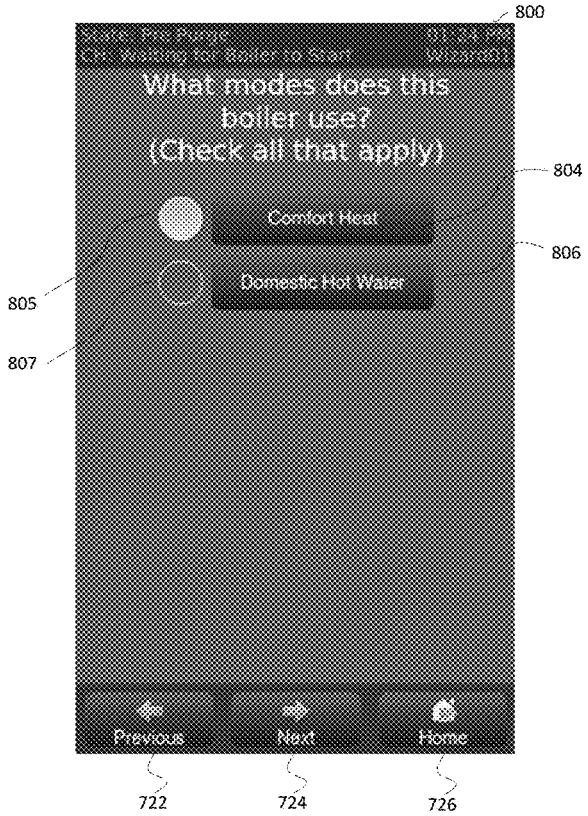

Turning to FIG. 8, a mode setup screen 800 is provided by the microcomputer via touchscreen display where the boiler mode(s) may be indicated by the user. For example, the touchscreen display provides the user with a comfort heat button 804 to instruct that the boiler is used for comfort heat. A corresponding indicator 805 of the users selection is changed as the user cycles the button from off to on. Similarly the touchscreen display provides the user with a domestic hot water button 806 to instruct the system to set the parameters for use of domestic hot water. Likewise a corresponding indicator 807 is provided. The buttons are not mutually exclusive and may both be turned on, off, or one on and the other off, at the users discretion. A similar lower portion navigation bar having a previous button, 722, a next button 724, and a home button 726 are provided.

Figure 9A:
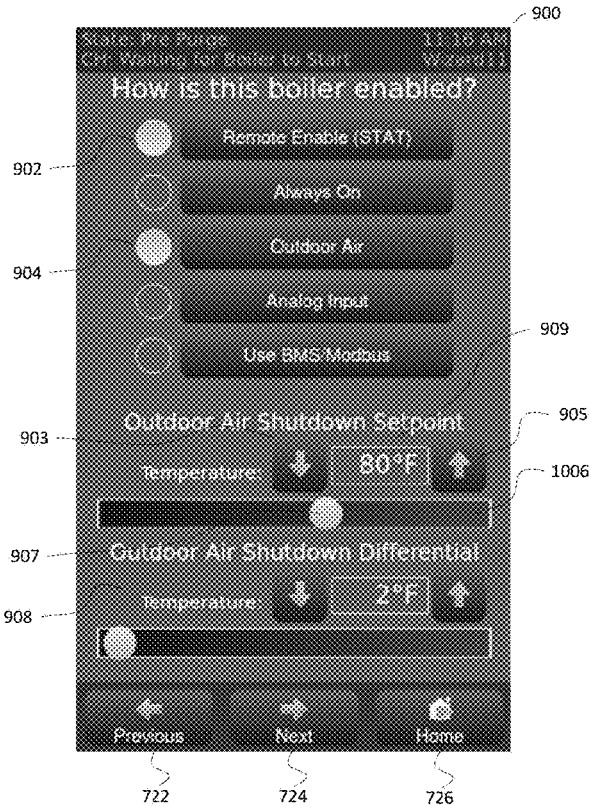
FIG. 9A-B are exemplary Set-Up touch-screen images for a boiler control system having slide controls.
Figure 9B:
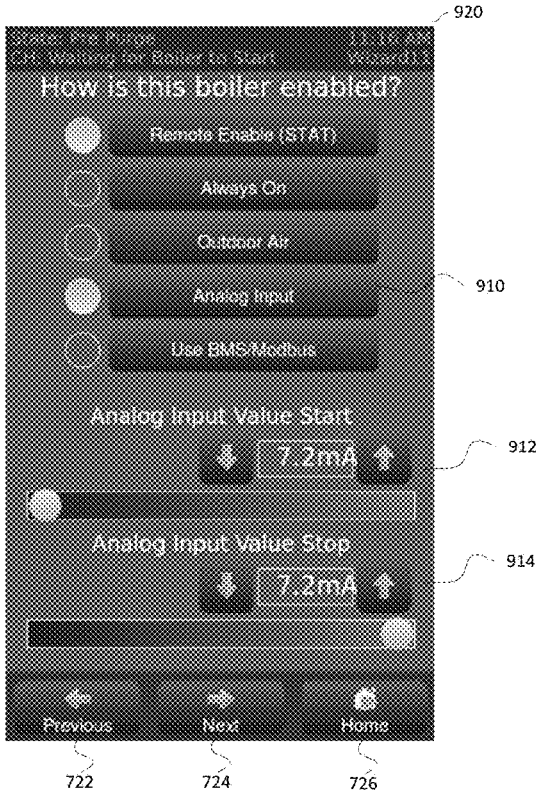

FIG. 9A-9B illustrate additional exemplary setup touchscreen displays 900, 920 for configuring the boiler before startup. An upper portion, similar to those previously described, is provided for the display of boiler state, as those described previously. FIG. 9A displays a remote enable (stat) condition 902 and an outdoor air selection 904 from the corresponding buttons. These touchscreens 900, 920, as well as others, may include several methods to enter data. Corresponding to the outdoor air selection the relevant Outdoor Air Shutdown Setpoint slider can be adjusted using arrows 903, 905 The arrows 903, 905 may be pressed to decrease or increase the setpoint number in the box 909. The dot 907 on the slider may be moved by the users finger touching the dot and moving side to side to raise or lower the number. Alternatively, an area on the slider may be touched to move the dot 907 and raise or lower the number, adjusting the setpoint value. The number box 909 may be touched, which may open a keypad (not shown) to directly enter the number. Additional uses of the slider by other screens may operate in a similar fashion. A similar outdoor air shutdown differential slider tool 908 is also shown to likewise modify the temperature differential displayed in the accompanied window. Similar to the prior screens an upper status portion and a lower navigating portion of the touchscreen display is provided.

FIG. 9B illustrates an exemplary setup touchscreen display for configuring the boiler before startup and differs from FIG. 9A by indication that the analog button 910 was pressed, having the corresponding indicator highlighted. With the analog input selection made, an analog input value start slider 912 is provided along with an analog input value stop slider 914, where the user can by the various actions described above, change the settings. In some instances of the touchscreen display, one or more buttons may be pressed wherein the respective selections are held active. In other cases, only one selection may remain active, and pressing any other button may deactivate the prior selection in favor of the current selection. In some screens a combination of active/inactive selections can be made. For instance in current touchscreen display of FIGS. 9A-B, the setting for Remote Enable (STAT) remains active regardless of whether the user selects the Outdoor Air option, or the Analog Input option by touching the respective buttons. The precision of the field values shown are sensitive to the data type entered. For instance, in the current case one place to the right of the decimal is provided and two places to the left of the decimal.

A user may navigate from screen to screen by use of the navigation buttons, previous and next, which are provided on most touchscreen displays for the system. When the system is operating, the system may leave a particular screen active, such that the values on that screen may be monitored. An optional feature may be to have the screen return to the home screen after a predetermined period of time. This option may be settable within the boiler control system.

Figure 10A:
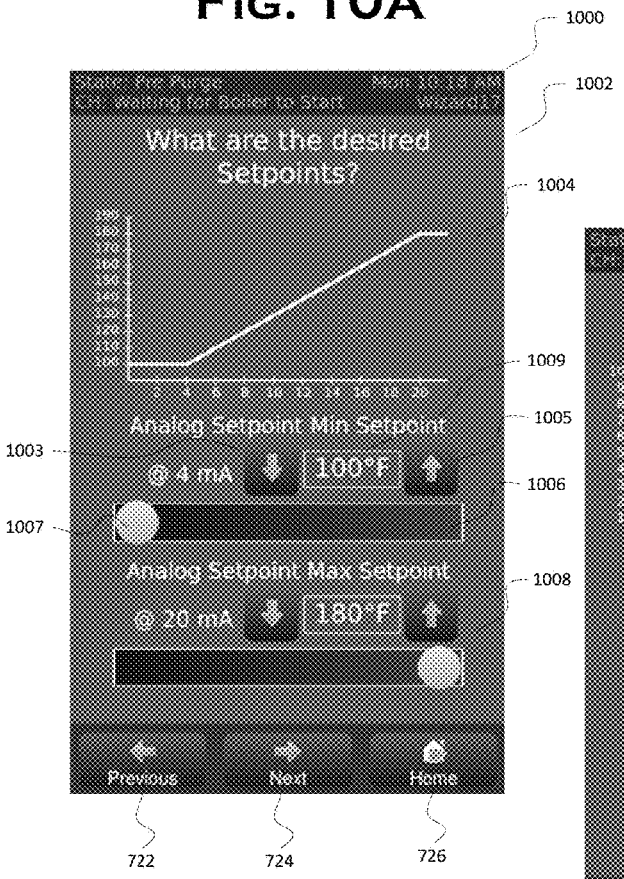
FIGS. 10A-11 are exemplary Set-Up touch-screen images for a boiler control system including a slide controls for parameter designation.

Turning to FIG. 10A, the sample screen 1000 illustrates an exemplary user interface touchscreen for accepting temperature related setpoint information from a user that may be displayed on a display coupled to the microcontroller. This screen, like others previously described, may include several methods to enter/adjust parameter data. The arrows 1003, 1005 may be pressed to decrease or increase the setpoint number in the box 1009. The dot 1007 on the slider may be moved to raise or lower the number, and may indicate a colored scale or change color as the scale is moved. Alternatively, an area on the slider may be touched to move the dot 1007 and raise or lower the number. The number box 1009 may be touched, which may open a keypad (not shown) to directly enter the number.

The user interface screen includes two slider controls for a "4 mA Setpoint" 1006 and "20 mA Setpoint" 1008 respectively. Other data entry values may also be used. In this example, the user may supply a 4 to 20 mA signal. The setpoint of the boiler/system may be changed according to the settings on this user interface screen. The graph 1004 may display settings in chart form. For example, with the settings shown in FIG. 10, an input signal of 12 mA may produce a setpoint of 140° F.

The touchscreen interface allows for a high input (e.g., 185 degrees) and a low input (e.g., 50 degrees) for each setpoint. Also, the effect of changing the number may be displayed in the graph above the data entry areas. The graph allows a user to see what effect changing a value will have on operation of the appliance (e.g., boiler).

Figure 10B:
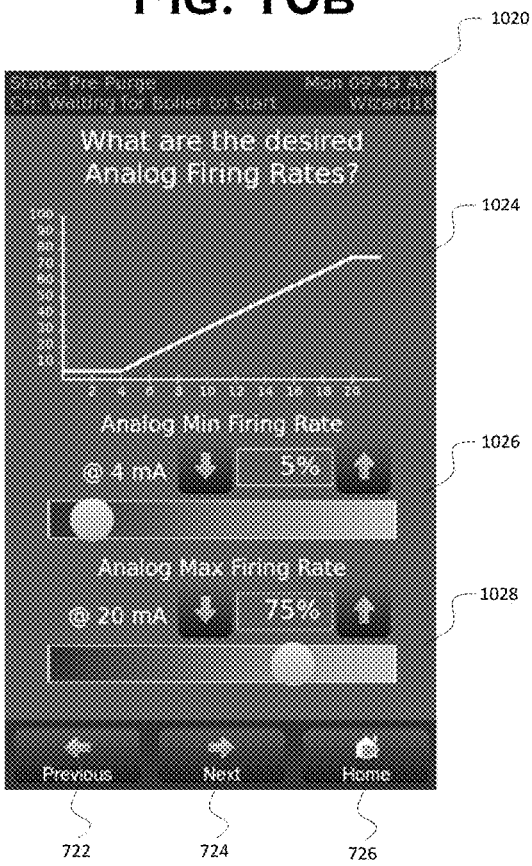

The sample screen 1020 of FIG. 10B illustrates a similar exemplary user interface touchscreen for accepting temperature related setpoint information from a user that may be displayed on a display coupled to the microcomputer. This screen, as well, may include several methods to enter/adjust data for the analog firing rates. An analog minimum firing rate may be entered/adjusted in the area 1026, similar to that described for FIG. 10A. Additionally the analog maximum firing rate 1028 may be entered likewise, using the method described above. The screen 1020 also having a chart 1024 may reflect the changes to the setpoint values 1026, 1028 in the chart 1024.

Figure 11:
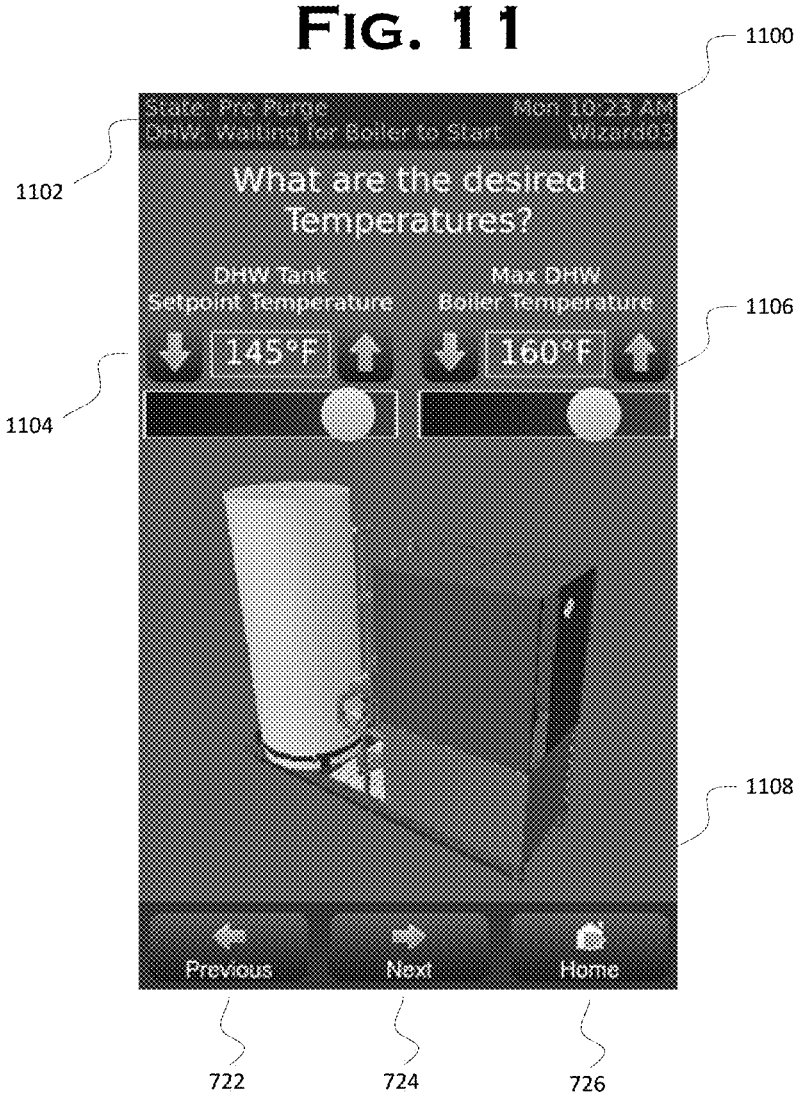

FIG. 11 illustrates an exemplary touchscreen display screen 1100 coupled to a microcomputer to accept user input for DHW Tank setpoint temperatures 1104 and maximum DHW boiler temperatures 1106. The center portion 1108 of the screen depicts an image showing a boiler in concerted with a DHW tank, for easy reference of the screen 1100. The navigation buttons appear as before, at the bottom.

Figure 12A:
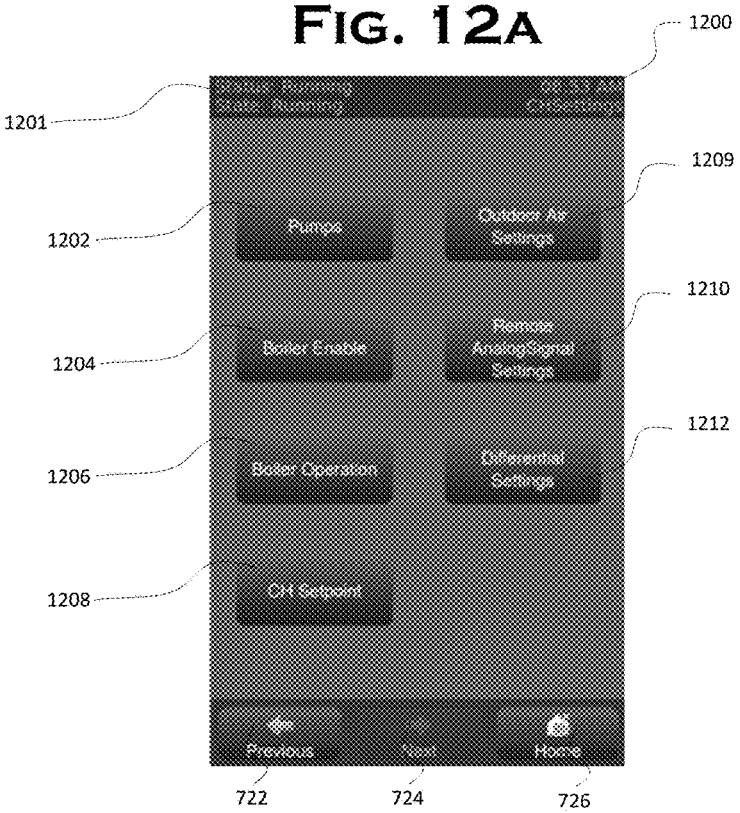
FIGS. 12A-13F are exemplary Runtime touch-screen images for a boiler control system, including menus, status displays, parameter configurations, and utilities.
Figure 12B:
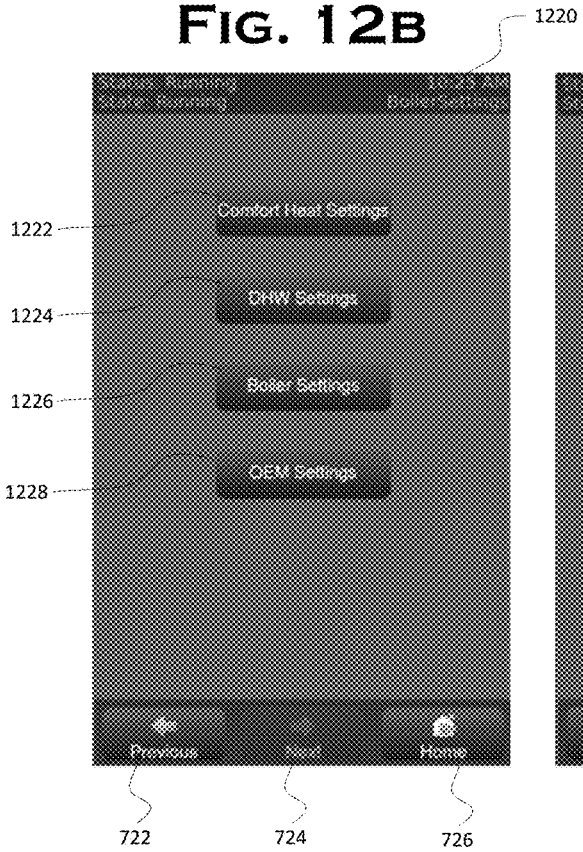
Figure 12C:
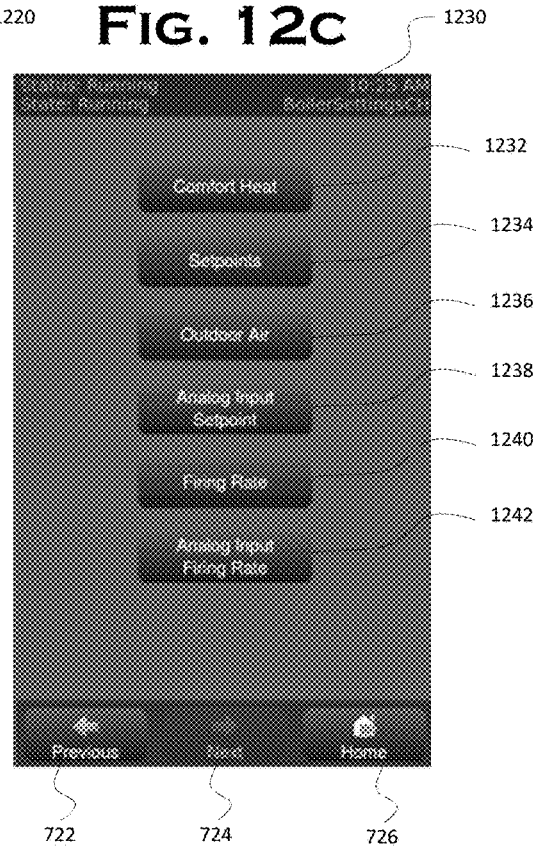

Turning to FIGS. 12A-12C, the sample screens 1200, 1220, 1230 illustrate exemplary user interface touchscreens for accepting temperature related setpoint information from a user that may be displayed on a display coupled to the microcontroller. The upper portion of the screen 1201 depicts the status and state of the boiler as running, while also indicating the system time and menu "CHSettings". From this touchscreen, a user is presented several options to choose from. The available buttons provide access to pumps 1202, boiler enable 1204, boiler operation 1206, CH setpoint 1208, outdoor air settings 1209, remote analog signal settings 1210, and differential settings 1212. Selection of the "previous" button 722 may take return the screen to the home screen. FIG. 12B depicts boiler settings, based on the header information provided. From here, the user is presented the menu choices: comfort heat settings 1222, DWH settings 1224, boiler settings 1226, and oem settings 1228. FIG. 12C presents the menu buttons comfort heat 1232, setpoints 1234, outdoor air 1236, analog input 1238, setpoint firing rate 1240, and analog input firing rate 1242 choices.

FIG. 13A-F illustrate exemplary runtime screens for viewing or changing the behavior of the boiler system. For example, screen 1300 provides multiple parameter setting status indications 1310 and a coinciding button for each to modify the related parameter. The screen may scroll to display additional status indications and coinciding buttons for changing the related parameter by sliding the user's finger vertically on the screen.

Figure 13A:
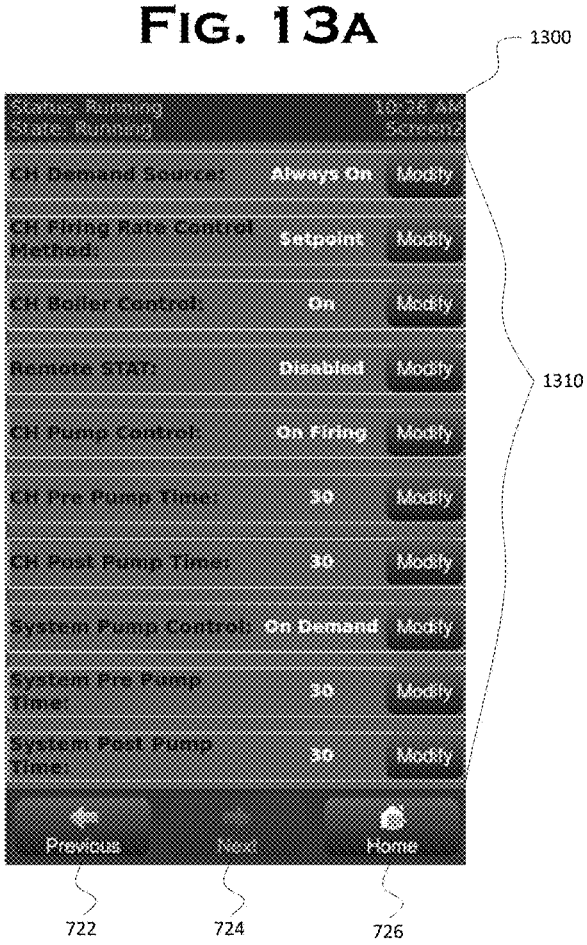
Figure 13B:
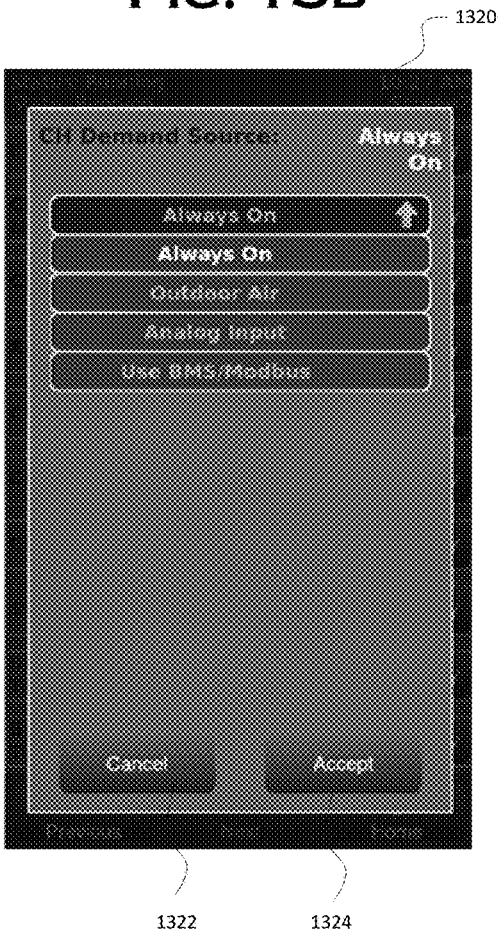
Figure 13C:
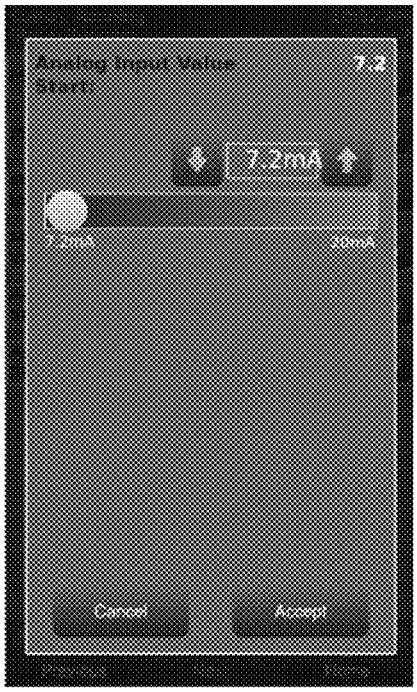
Figure 13D:
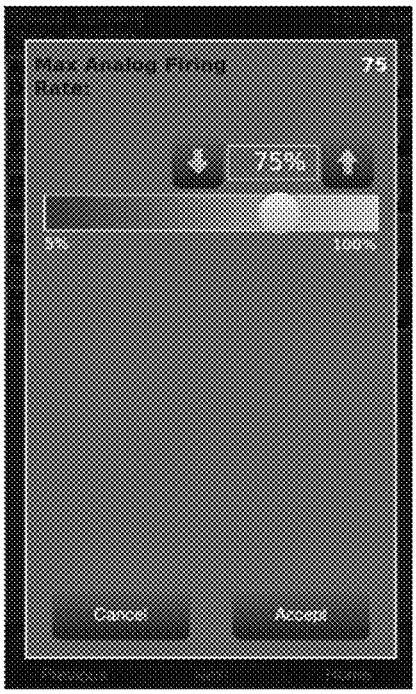
Figure 13E:
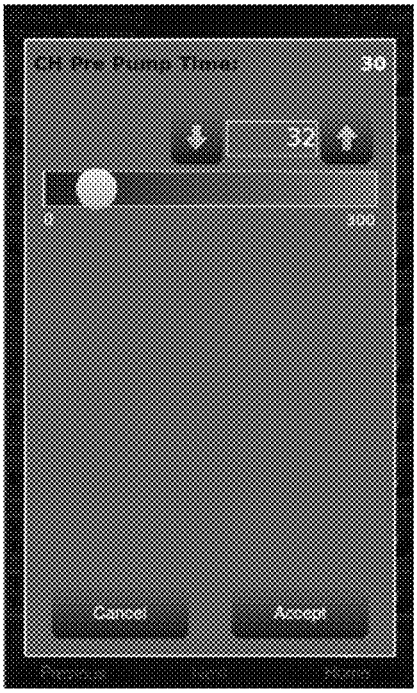
Figure 13F:
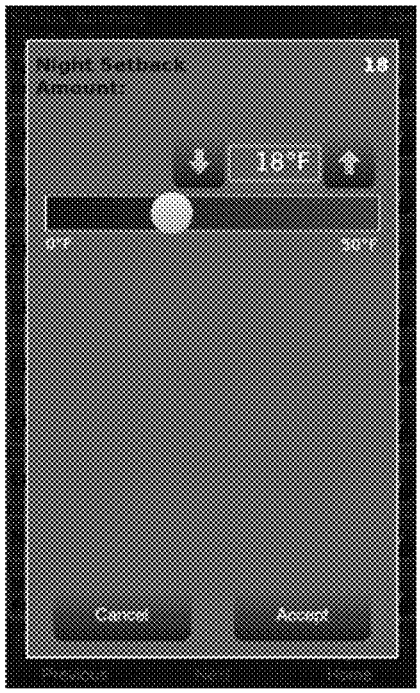

Selecting the first modify button under CH Demand Source of screen 1300, may cause the microcomputer to retrieve and display the data on a CH Demand Source screen 1320 as shown in FIG. 13B. This exemplary screen allows a user to change the setting of the demand source and confirm their choice by selecting either the accept button 1324, or the cancel button 1322, thereby returning to the prior screen. FIGS. 13C-F depict additional exemplary screens, similar to that of screen 1320. FIG. 13C depicts a screen to modify the analog input value, while the screen of FIG. 13D depicts max analog firing rate and a means to change the percentage. FIG. 13E and FIG. 13F depict exemplary screens for CH pre pump time and night setback amount respectively. Each screen also showing the capacity to accept a change of the displayed value via a slider, or arrow. Confirmation of the change by "accept" or "cancel" are additionally provided for the user to enter their changes or return to the previous screen.

The above embodiments of the present invention are illustrative and not limiting. Various alternatives and equivalents are possible. Other additions, subtractions or modifications are obvious in view of the present disclosure and are intended to fall within the scope of the appended claims

We claim:

1. A boiler control system comprising:

a microcontroller configured to provide flame safeguard operations by a first processor; and a microcomputer, having a second processor and a first memory, operatively connected to said microcontroller, said microcomputer configured to provide operating control via said second processor and receive operating conditions from said microcontroller, said microcomputer storing in said first memory instructions for said second processor to process said operating control to determine boiler flow for processing by said second processor, wherein said instructions for said operating control to determine boiler flow comprises the steps of:

(a) determine a power P at a running speed;

(b) determine a cubed ratio R by calculating the cube of a ratio between a full speed and said running speed;

(c) determine a result C by multiplying said power P determined in (a) by said cubed ratio R determined in (b);

(d) find an associated full speed flow $F_{fs}$ from the value obtained at (c);

(e) determine actual flow $F_a$ by dividing said associated full speed flow $F_{fs}$ found by (d) by a ratio of full speed to actual speed; and (f) verify flow $F_a$ of (e).

2. The boiler control system of claim 1, wherein said microcomputer further comprises one or more external interface ports to connect external devices, said microcomputer providing connection, via said one or more external interface ports, to an external device storing updated instructions for said operating control to update said first memory of said boiler control system.

3. The boiler control system of claim 2, wherein said boiler control system is returned to operation absent recertification after said updated instructions are stored within said first memory.

4. The boiler control system of claim 2, wherein said one or more external interface ports includes one or more of the following:

a Universal Serial Bus (USB) port;

a secure digital memory card (SD card) slot;

an Ethernet port; and a Wireless Local Area Network (WLAN).

5. The boiler control system of claim 4, wherein said first memory stores heartbeat system instructions for said second processor to periodically poll cascade member boilers to determine the presence of said cascade member boiler.

6. The boiler control system of claim 1, wherein said microcomputer is configured to connect to one or more cascade member boilers in a configuration selected from the group consisting of: a parallel configuration, and a series configuration.

7. The boiler control system of claim 1, wherein said microcomputer further comprises:

one or more operating control parameters stored in said first memory; and a communication interface for communicating, as a cascade master, at least one of said one or more operating control parameters to one or more cascade member boilers, determining what setpoint or firing rate the member boiler is to run.

8. The boiler control system of claim 7, wherein said first memory on said microcomputer stores heartbeat system instructions to receive and respond to a heartbeat request from at least one of said one or more cascade member boilers by said second processor.

9. The boiler control system of claim 7, wherein said first memory is configured to store updated instructions for said operating control received via a communication interface of said microcomputer from at least one of said one or more cascade member boilers.

10. The boiler control system of claim 1, wherein said microcomputer further comprises:

a communication interface configured to receive for storage by said first memory and processed by said second processor one or more operating control parameters from a cascade member boiler, determining what setpoint or firing rate the boiler control system is to run.

11. A boiler control system comprising:

a microcontroller configured to provide flame safeguard operations by a first processor; and a microcomputer, having a second processor and a first memory, operatively connected to said microcontroller, said microcomputer configured to provide operating control via said second processor and receive operating conditions from said microcontroller, said microcomputer storing in said first memory instructions for said second processor to process said operating control to determine boiler flow for processing by said second processor, wherein said instructions for said operating control to determine boiler flow are calculated by the formula:

$$\text{Flow}=[(F_h-F_l)/(P_h-P_l)]*[(P_i*(S_m/S_i)^3)-P_l)+F_l]/[S_m/S_i]$$

wherein $P_i$ is a power value at a given running speed in watts, $S_m$ is a maximum running speed in hertz, $S_i$ is a given running speed in hertz, $F_h$ is a high flow rate of a pump in gallons per minute, $F_l$ is a low flow rate of said pump in gallons per minute, $P_h$ is a high power value for driving said pump from a motor at said high flow rate in watts, $P_l$ is a low power value for driving said pump from said motor at said low flow rate in watts.

12. The boiler control system of claim 11, wherein said microcomputer further comprises one or more external interface ports to connect external devices, said microcomputer providing connection, via said one or more external interface ports, to an external device storing updated instructions for said operating control to update said first memory of said boiler control system.

13. The boiler control system of claim 12, wherein said boiler control system is returned to operation absent recertification after said updated instructions are stored within said first memory.

14. The boiler control system of claim 12, wherein said one or more external interface ports includes one or more of the following:

a Universal Serial Bus (USB) port;

a secure digital memory card (SD card) slot;

an Ethernet port; and a Wireless Local Area Network (WLAN).

15. The boiler control system of claim 11, wherein said microcomputer is configured to connect to one or more cascade member boilers in a configuration selected from the group consisting of: a parallel configuration, and a series configuration.

16. The boiler control system of claim 11, wherein said microcomputer further comprises:

one or more operating control parameters stored in said first memory; and a communication interface for communicating, as a cascade master, at least one of said one or more operating control parameters to one or more cascade member boilers, determining what setpoint or firing rate the member boiler is to run.

17. The boiler control system of claim 14, wherein said first memory stores heartbeat system instructions for said second processor to periodically poll cascade member boilers to determine the presence of said cascade member boiler.

18. The boiler control system of claim 16, wherein said first memory on said microcomputer stores heartbeat system instructions to receive and respond to a heartbeat request from at least one of said one or more cascade member boilers by said second processor.

19. The boiler control system of claim 16, wherein said first memory is configured to store updated instructions for said operating control received via a communication interface of said microcomputer from at least one of said one or more cascade member boilers.

20. The boiler control system of claim 11, wherein said microcomputer further comprises:

a communication interface configured to receive for storage by said first memory and processed by said second processor one or more operating control parameters from a cascade member boiler, determining what setpoint or firing rate the boiler control system is to run.

* * * * *